US011254537B2

(12) United States Patent
Emoto et al.

(10) Patent No.: US 11,254,537 B2
(45) Date of Patent: Feb. 22, 2022

(54) PRINTING APPARATUS AND METHOD OF CONTROLLING PRINTING APPARATUS

(71) Applicant: CANON KABUSHIKI KAISHA, Tokyo (JP)

(72) Inventors: Yuki Emoto, Tokyo (JP); Kosuke Yamamoto, Yokohama (JP); Norio Sakurai, Tokyo (JP); Toshiaki Somano, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 320 days.

(21) Appl. No.: 16/420,393

(22) Filed: May 23, 2019

(65) Prior Publication Data

US 2019/0366746 A1 Dec. 5, 2019

(30) Foreign Application Priority Data

May 31, 2018 (JP) ..... JP2018-105144

(51) Int. Cl.
*B65H 33/08* (2006.01)
*B65H 31/00* (2006.01)

(52) U.S. Cl.
CPC ..... *B65H 33/08* (2013.01); *B65H 31/00* (2013.01); *B65H 2405/11* (2013.01); *B65H 2405/32* (2013.01); *B65H 2405/351* (2013.01); *B65H 2515/40* (2013.01); *B65H 2515/805* (2013.01); *B65H 2801/06* (2013.01)

(58) Field of Classification Search
CPC .. B65H 33/08; B65H 31/00; B65H 2405/351; B65H 2405/11; B65H 2405/32; B65H 3405/324
See application file for complete search history.

(56) References Cited

U.S. PATENT DOCUMENTS 10,005,637 B1 * 6/2018 Wilsher ..... B65H 43/00
2008/0265491 A1 * 10/2008 Yamauchi ..... B65H 1/26 271/118

FOREIGN PATENT DOCUMENTS

JP 2006-016109 A 1/2006
WO WO-2017099745 A1 * 6/2017 ..... B41J 29/00

OTHER PUBLICATIONS

U.S. Appl. No. 16/423,654, filed May 28, 2019 (First Named Inventor: Norio Sakurai).
U.S. Appl. No. 16/423,361, filed May 28, 2019 (First Named Inventor: Yuki Emoto).
U.S. Appl. No. 16/416,483, filed May 20, 2019 (First Named Inventor: Toshiaki Somano).

* cited by examiner

*Primary Examiner* — Jeremy R Severson
(74) *Attorney, Agent, or Firm* — Venable LLP

(57) ABSTRACT

Provided is a printing apparatus comprising: a discharging unit configured to convey and discharge print media; a tray configured to receive print media discharged in a first direction from the discharging unit; and a drive unit configured to move the tray in a second direction perpendicular to the first direction. In discharging print media, the tray is moved in the second direction to thereby receive the discharged print media at a plurality of different positions on the tray. The tray is movable to a take-out position being a position closer in the second direction to a take-out side where print media are taken out than any of the positions at which the tray receives the print media discharged from the discharging unit.

19 Claims, 18 Drawing Sheets

PRINTING APPARATUS AND METHOD OF CONTROLLING PRINTING APPARATUS

This application claims the benefit of Japanese Patent Application No. 2018-105144, filed May 31, 2018, which is hereby incorporated by reference in its entirety.

BACKGROUND OF THE INVENTION

Field of the Invention

The present invention relates to a printing apparatus comprising a movable discharging tray and a method of controlling a printing apparatus.

Description of the Related Art

There have been printing apparatuses comprising a movable discharging tray. Japanese Patent Laid-Open No. 2006-16109 (hereinafter referred to as Document 1) describes a technique in which a sheet tray movable to a front position and a rear position is moved to the front position after sorting of discharged sheets is completed. According to the technique in Document 1, sheets discharged with the sheet tray at the rear position are moved to the front side as the sheet tray is moved to the front position after the sorting is completed. Accordingly, the user can easily take out the sheets.

In the technique in Document 1, however, any pile of sheets discharged with the sheet tray at the front position cannot be moved toward the near side (front side) in the sheet take out direction. Hence, the technique in Document 1 cannot improve the ease of taking out piles of sorted sheets as a whole.

SUMMARY OF THE INVENTION

A printing apparatus according to an aspect of the present invention comprises: a discharging unit configured to discharge print media; a tray configured to receive print media discharged in a first direction from the discharging unit; and a drive unit configured to move the tray in a second direction crossing the first direction. In discharging print media, the tray is moved in the second direction to thereby receive the discharged print media at a plurality of different positions on the tray. The tray is movable to a take-out position being a position closer in the second direction to a take-out side where print media are taken out than any of the positions at which the tray receives the print media discharged from the discharging unit.

Further features of the present invention will become apparent from the following description of exemplary embodiments with reference to the attached drawings.

DESCRIPTION OF THE EMBODIMENTS

Figure 1:
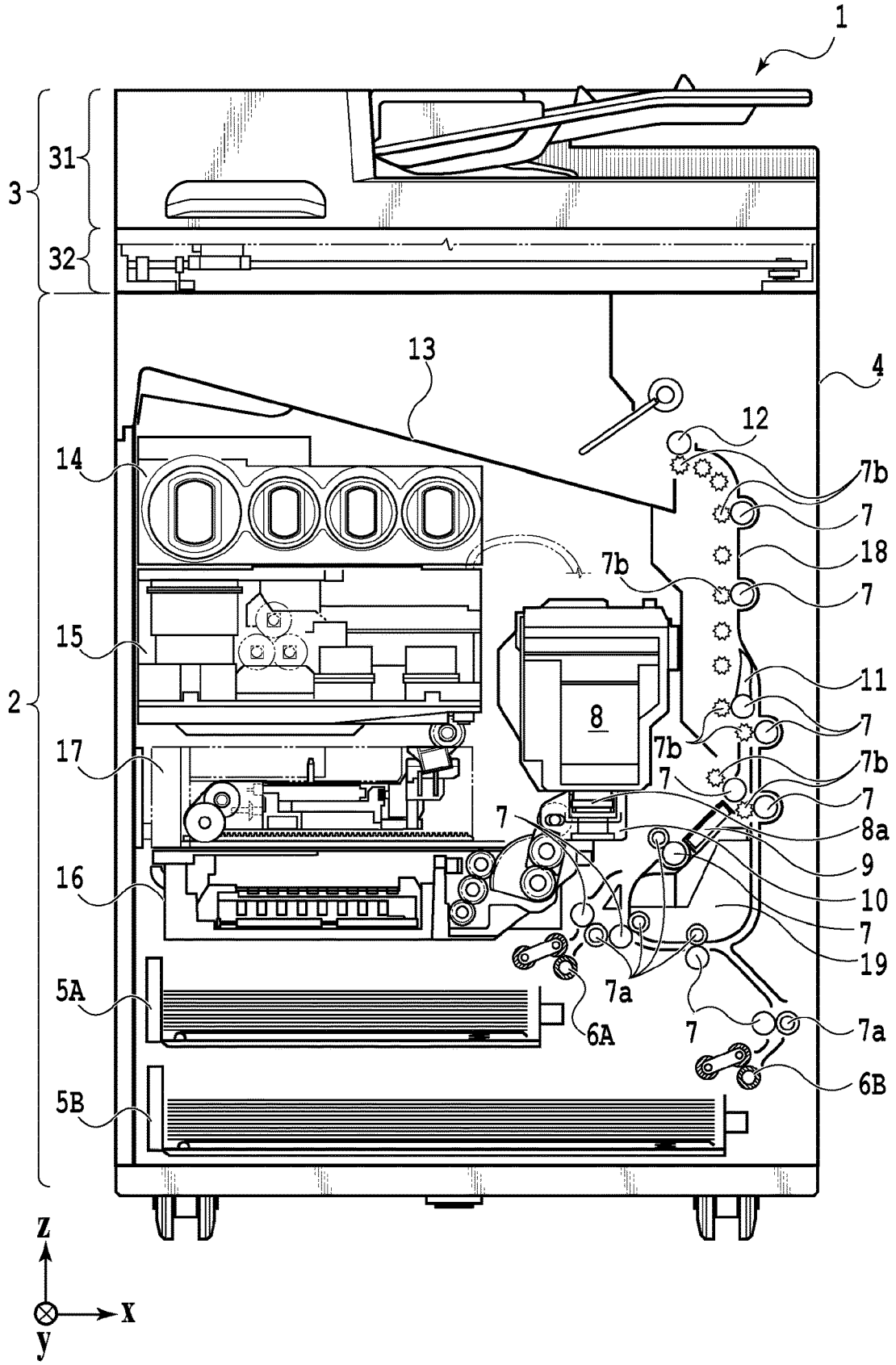
FIG. 1 is a diagram showing a printing apparatus in a standby state.

Embodiments of the present invention will be described with reference to the drawings. It should be noted that the following embodiments do not limit the present invention and that not all of the combinations of the characteristics described in the present embodiments are essential for solving the problem to be solved by the present invention. Incidentally, the same reference numeral refers to the same component in the following description. Furthermore, relative positions, shapes, and the like of the constituent elements described in the embodiments are exemplary only and are not intended to limit the scope of the invention.

FIG. 1 is an internal configuration diagram of an inkjet printing apparatus 1 (hereinafter "printing apparatus 1") used in the present embodiment. In the drawings, an x-direction is a horizontal direction, a y-direction (a direction perpendicular to paper) is a direction in which ejection openings are arrayed in a print head 8 described later, and a z-direction is a vertical direction.

The printing apparatus 1 is a multifunction printer comprising a print unit 2 and a scanner unit 3. The printing apparatus 1 can use the print unit 2 and the scanner unit 3 separately or in synchronization to perform various processes related to print operation and scan operation. The scanner unit 3 comprises an automatic document feeder (ADF) 31 and a flatbed scanner (FBS) 32 and is capable of scanning a document automatically fed by the ADF 31 as well as scanning a document placed by a user on a document plate of the FBS 32. The present embodiment is directed to the multifunction printer comprising both the print unit 2 and the scanner unit 3, but the scanner unit 3 may be omitted. FIG. 1 shows the printing apparatus 1 in a standby state in which neither print operation nor scan operation is performed.

In the print unit 2, a first cassette 5A and a second cassette 5B for housing a print medium (cut sheet) S are detachably provided at the bottom of a casing 4 in the vertical direction. A relatively small print medium of up to A4 size is placed flat and housed in the first cassette 5A and a relatively large print medium of up to A3 size is placed flat and housed in the second cassette 5B. A first feeding unit 6A for sequentially feeding a housed print medium is provided near the first cassette 5A. Similarly, a second feeding unit 6B is provided near the second cassette 5B. In print operation, a print medium S is selectively fed from either one of the cassettes.

Conveying rollers 7, a discharging roller 12, pinch rollers 7*a*, spurs 7*b*, a guide 18, an inner guide 19, and a flapper 11 are conveying mechanisms for guiding a print medium S in a predetermined direction. The conveying rollers 7 are drive rollers located upstream and downstream of the print head 8 (platen 9) and driven by a conveying motor. The pinch rollers 7*a* are follower rollers that are turned while nipping a print medium S together with the conveying rollers 7. The discharging roller 12 is a drive roller located downstream of the conveying rollers 7 and driven by the discharging motor. The spurs 7*b* nip and convey a print medium S together with the conveying rollers 7 and discharging roller 12 located downstream of the print head 8 (platen 9).

The printing apparatus 1 is provided with a plurality of motors that drive the above drive rollers, and each of the above drive rollers is connected to one of the plurality of motors. The association between the motors and the drive rollers will be described later in detail.

The guide 18 is provided in a conveying path of a print medium S to guide the print medium S in a predetermined direction. The inner guide 19 is a member extending in the y-direction. The inner guide 19 has a curved side surface and guides a print medium S along the side surface. The flapper 11 is a member for changing a direction in which a print medium S is conveyed in duplex print operation. A discharging tray 13 is a tray for placing and housing a print medium S that was subjected to print operation and discharged by the discharging roller 12.

The print head 8 of the present embodiment is a full line type color inkjet print head. In the print head 8, a plurality of ejection openings configured to eject ink based on print data are arrayed in the y-direction in FIG. 1 so as to correspond to the width of a print medium S. When the print head 8 is in a standby position, an ejection opening surface 8*a* of the print head 8 is oriented vertically downward and capped with a cap unit 10 as shown in FIG. 1. In print operation, the orientation of the print head 8 is changed by a print controller 202 described later such that the ejection opening surface 8*a* faces a platen 9. The platen 9 includes a flat plate extending in the y-direction and supports, from the back side, a print medium S subjected to print operation by the print head 8. The movement of the print head 8 from the standby position to a printing position will be described later in detail.

An ink tank unit 14 separately stores ink of four colors to be supplied to the print head 8. An ink supply unit 15 is provided in the midstream of a flow path connecting the ink tank unit 14 to the print head 8 to adjust the pressure and flow rate of ink in the print head 8 within a suitable range. The present embodiment adopts a circulation type ink supply system, where the ink supply unit 15 adjusts the pressure of ink supplied to the print head 8 and the flow rate of ink collected from the print head 8 within a suitable range.

A maintenance unit 16 comprises the cap unit 10 and a wiping unit 17 and activates them at predetermined timings to perform maintenance operation for the print head 8. The maintenance operation will be described later in detail.

<Block Diagram>

Figure 2:
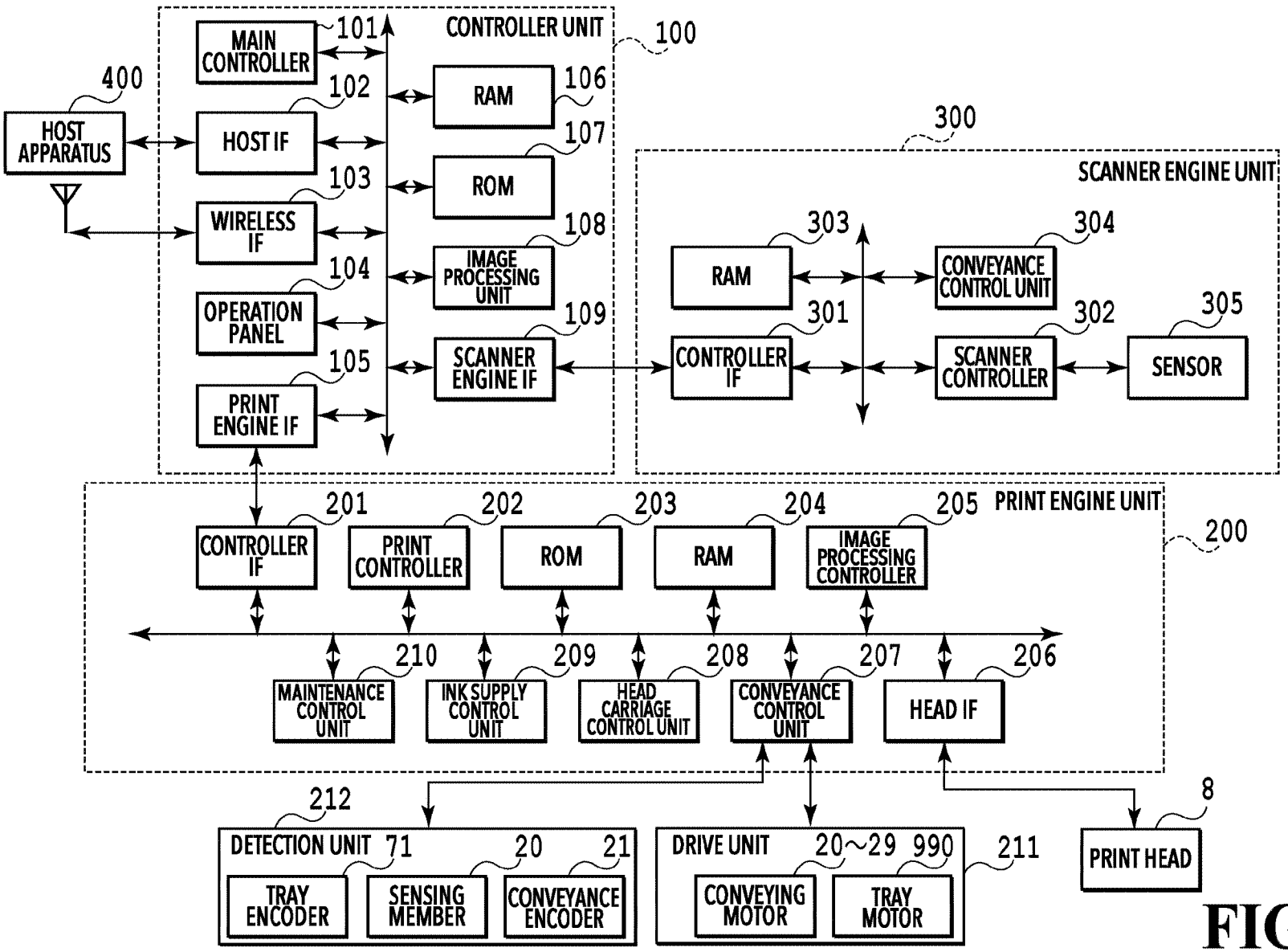
FIG. 2 is a control configuration diagram of the printing apparatus.

FIG. 2 is a block diagram showing a control configuration in the printing apparatus 1. The control configuration mainly includes a print engine unit 200 that exercises control over the print unit 2, a scanner engine unit 300 that exercises control over the scanner unit 3, and a controller unit 100 that exercises control over the entire printing apparatus 1. A print controller 202 controls various mechanisms of the print engine unit 200 under instructions from a main controller 101 of the controller unit 100. Various mechanisms of the scanner engine unit 300 are controlled by the main controller 101 of the controller unit 100. The control configuration will be described below in detail.

In the controller unit 100, the main controller 101 including a CPU controls the entire printing apparatus 1 using a RAM 106 as a work area in accordance with various parameters and programs stored in a ROM 107. For example, when a print job is input from a host apparatus 400 via a host I/F 102 or a wireless I/F 103, an image processing unit 108 executes predetermined image processing for received image data under instructions from the main controller 101. The main controller 101 transmits the image data subjected to the image processing to the print engine unit 200 via a print engine I/F 105.

The printing apparatus 1 may acquire image data from the host apparatus 400 via a wireless or wired communication or acquire image data from an external storage unit (such as a USB memory) connected to the printing apparatus 1. A communication system used for the wireless or wired communication is not limited. For example, as a communication system for the wireless communication, Wi-Fi (Wireless Fidelity; registered trademark) and Bluetooth (registered trademark) can be used. As a communication system for the wired communication, a USB (Universal Serial Bus) and the like can be used. For example, when a scan command is input from the host apparatus 400, the main controller 101 transmits the command to the scanner unit 3 via a scanner engine I/F 109.

An operating panel 104 is a mechanism to allow a user to do input and output for the printing apparatus 1. A user can give an instruction to perform operation such as copying and scanning, set a print mode, and recognize information about the printing apparatus 1 via the operating panel 104.

In the print engine unit 200, the print controller 202 including a CPU controls various mechanisms of the print unit 2 using a RAM 204 as a work area in accordance with various parameters and programs stored in a ROM 203. When various commands and image data are received via a controller I/F 201, the print controller 202 temporarily stores them in the RAM 204. The print controller 202 allows an image processing controller 205 to convert the stored image data into print data such that the print head 8 can use it for print operation. After the generation of the print data, the print controller 202 allows the print head 8 to perform print operation based on the print data via a head I/F 206. In doing so, the print controller 202 controls the conveyance and discharge of a print medium S by driving the feeding unit 6A or 6B, conveying rollers 7, the discharging roller 12, the flapper 11, and the discharging tray 13, which are illustrated in FIG. 1, through the conveyance control unit 207.

The conveyance control unit 207 is connected to sensing units 212 that sense the state of conveyance of print media S and a drive unit 211 that drives the plurality of drive rollers and the discharging tray 13. Each sensing unit 212 comprises a sensing member 20 that senses the presence or absence of a print medium S, a conveyance encoder 21 that detects the amount of rotation of a corresponding drive roller, and a tray encoder 71 that detects the amount of rotation of a tray motor 990. The drive unit 211 comprises a plurality of conveying motors 22 to 29 which are used to convey print media S and the tray motor 990, which drives the discharging tray 13.

The conveyance control unit 207 controls the conveyance of print media S by using the drive unit 211 on the basis of the results of sensing obtained from the sensing units 212. While a print medium S is conveyed by the conveyance control unit 207, a print operation is performed by the print head 8 in accordance with instructions from the print controller 202 to thereby perform a print process. Also, in a case where the print command includes an instruction to sort print media, the conveyance control unit 207 drives the tray motor 990 to sort discharged print media on the discharging tray 13. The sorting refers arranging print media S at different positions on the discharging tray 13 by horizontally moving the discharging tray 13 relative to the discharge port.

A head carriage control unit 208 changes the orientation and position of the print head 8 in accordance with an operating state of the printing apparatus 1 such as a maintenance state or a printing state. An ink supply control unit 209 controls the ink supply unit 15 such that the pressure of ink supplied to the print head 8 is within a suitable range. A maintenance control unit 210 controls the operation of the cap unit 10 and wiping unit 17 in the maintenance unit 16 when performing maintenance operation for the print head 8.

In the scanner engine unit 300, the main controller 101 controls hardware resources of the scanner controller 302 using the RAM 106 as a work area in accordance with various parameters and programs stored in the ROM 107, thereby controlling various mechanisms of the scanner unit 3. For example, the main controller 101 controls hardware resources in the scanner controller 302 via a controller I/F 301. The scanner controller 302 causes a conveyance control unit 304 to convey a document placed by a user on the ADF 31 and cause a sensor 305 to scan the document. The scanner controller 302 stores scanned image data in a RAM 303. The print controller 202 can convert the image data acquired as described above into print data to enable the print head 8 to perform print operation based on the image data scanned by the scanner controller 302.

Figure 3:
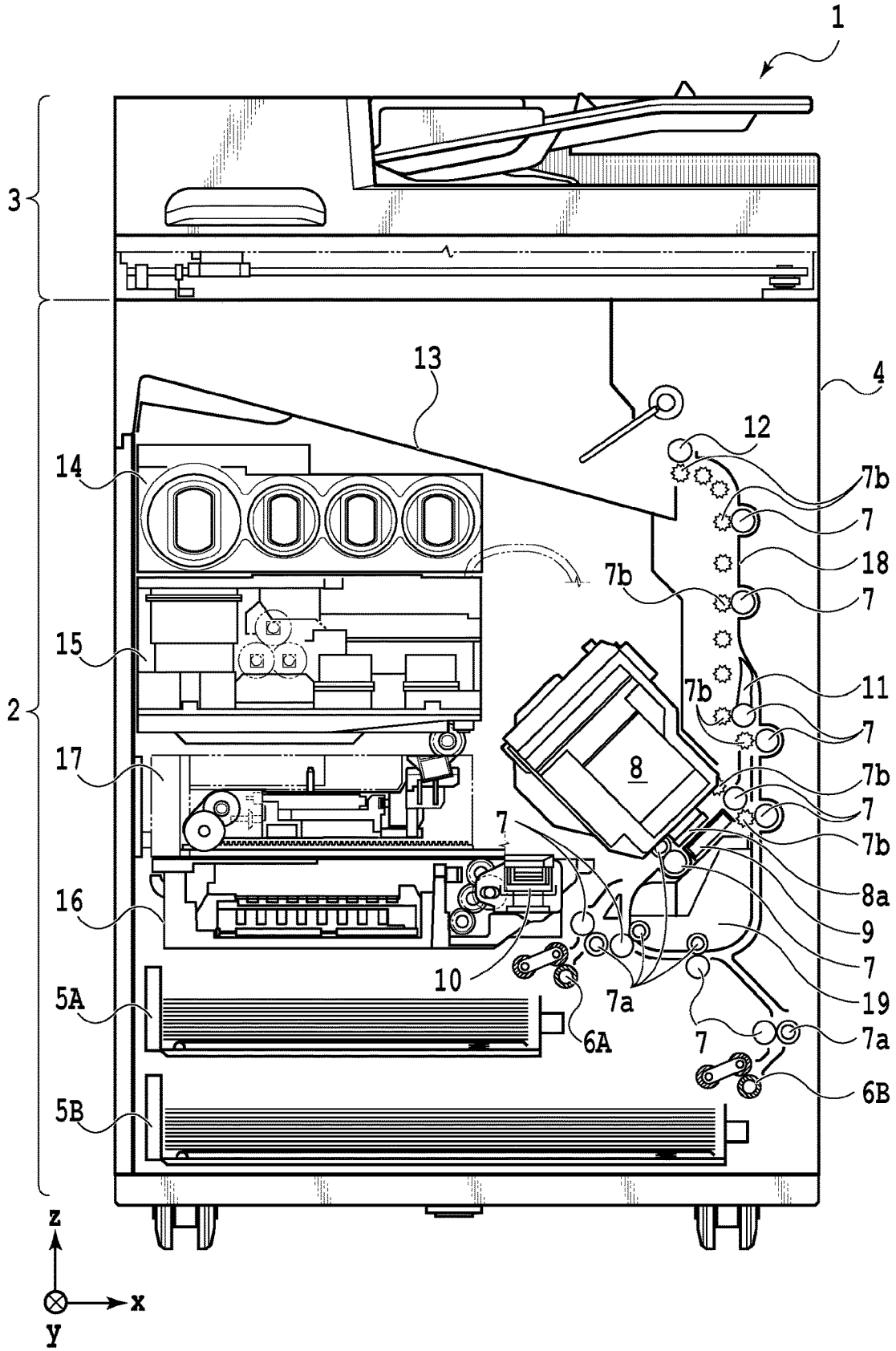
FIG. 3 is a diagram showing the printing apparatus in a printing state.

FIG. 3 shows the printing apparatus 1 in a printing state. As compared with the standby state shown in FIG. 1, the cap unit 10 is separated from the ejection opening surface 8*a* of the print head 8 and the ejection opening surface 8*a* faces the platen 9. In the present embodiment, the plane of the platen 9 is inclined about 45° with respect to the horizontal plane. The ejection opening surface 8*a* of the print head 8 in a printing position is also inclined about 45° with respect to the horizontal plane so as to keep a constant distance from the platen 9.

In the case of moving the print head 8 from the standby position shown in FIG. 1 to the printing position shown in FIG. 3, the print controller 202 uses the maintenance control unit 210 to move the cap unit 10 down to an evacuation position shown in FIG. 3, thereby separating the cap member 10*a* from the ejection opening surface 8*a* of the print head 8. The print controller 202 then uses the head carriage control unit 208 to turn the print head 8 45° while adjusting the vertical height of the print head 8 such that the ejection opening surface 8*a* faces the platen 9. After the completion of print operation, the print controller 202 reverses the above procedure to move the print head 8 from the printing position to the standby position.

Next, a conveying path of a print medium S in the print unit 2 will be described. When a print command is input, the print controller 202 first uses the maintenance control unit 210 and the head carriage control unit 208 to move the print head 8 to the printing position shown in FIG. 3. The print controller 202 then uses the conveyance control unit 207 to drive either the first feeding unit 6A or the second feeding unit 6B in accordance with the print command and feed a print medium S.

Figure 4C:
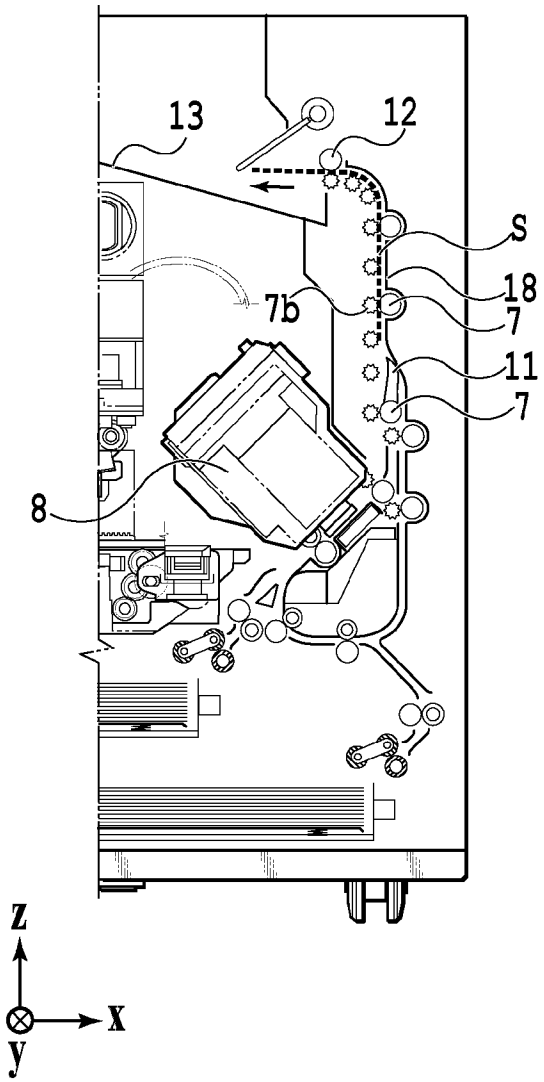
FIGS. 4A to 4C are conveying path diagrams of a print medium fed from a first cassette.
Figure 4B:
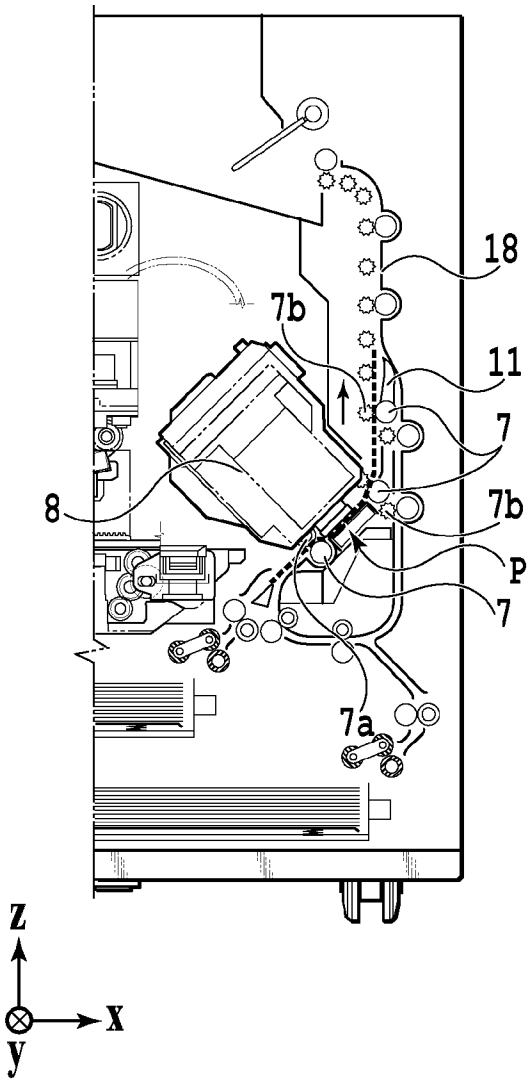
Figure 4A:
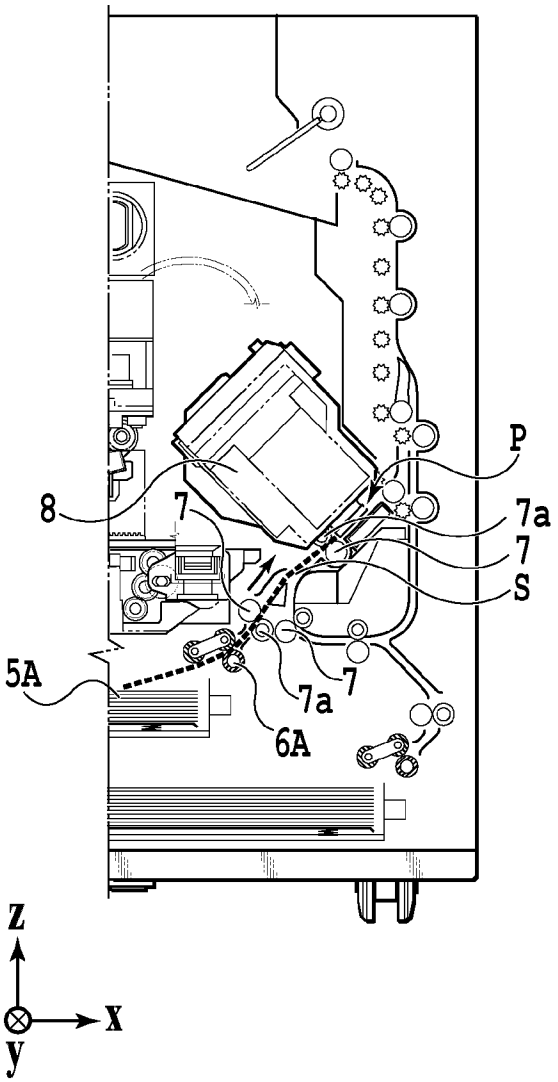

FIGS. 4A to 4C are diagrams showing a conveying path in the case of feeding an A4 size print medium S from the first cassette 5A. A print medium S at the top of a print medium stack in the first cassette 5A is separated from the rest of the stack by the first feeding unit 6A and conveyed toward a print area P between the platen 9 and the print head 8 while being nipped between the conveying rollers 7 and the pinch rollers 7*a*. FIG. 4A shows a conveying state where the front end of the print medium S is about to reach the print area P. The direction of movement of the print medium S is changed from the horizontal direction (x-direction) to a direction inclined about 45° with respect to the horizontal direction while being fed by the first feeding unit 6A to reach the print area P.

In the print area P, a plurality of ejection openings provided in the print head 8 eject ink toward the print medium S. In an area where ink is applied to the print medium S, the back side of the print medium S is supported by the platen 9 so as to keep a constant distance between the ejection opening surface 8*a* and the print medium S. After ink is applied to the print medium S, the conveying rollers 7 and the spurs 7*b* guide the print medium S such that the print medium S passes on the left of the flapper 11 with its tip inclined to the right and is conveyed along the guide 18 in the vertically upward direction of the printing apparatus 1. FIG. 4B shows a state where the front end of the print medium S has passed through the print area P and the print medium S is being conveyed vertically upward. The conveying rollers 7 and the spurs 7*b* change the direction of movement of the print medium S from the direction inclined about 45° with respect to the horizontal direction in the print area P to the vertically upward direction.

After being conveyed vertically upward, the print medium S is discharged into the discharging tray 13 by the discharging roller 12 and the spurs 7*b*. FIG. 4C shows a state where the front end of the print medium S has passed through the discharging roller 12 and the print medium S is being discharged into the discharging tray 13. The discharged print medium S is held in the discharging tray 13 with the side on which an image was printed by the print head 8 down.

Figure 5C:
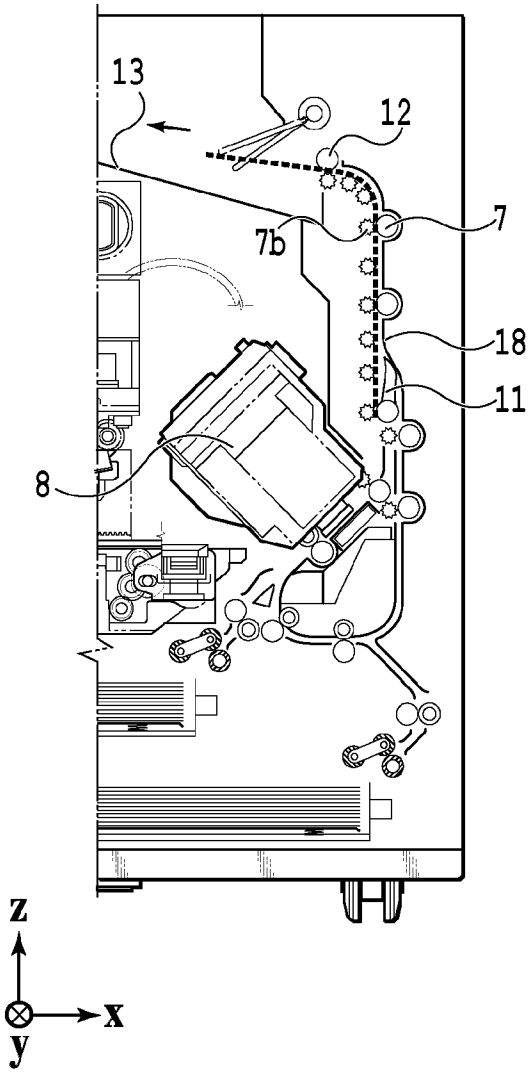
FIGS. 5A to 5C are conveying path diagrams of a print medium fed from a second cassette.
Figure 5B:
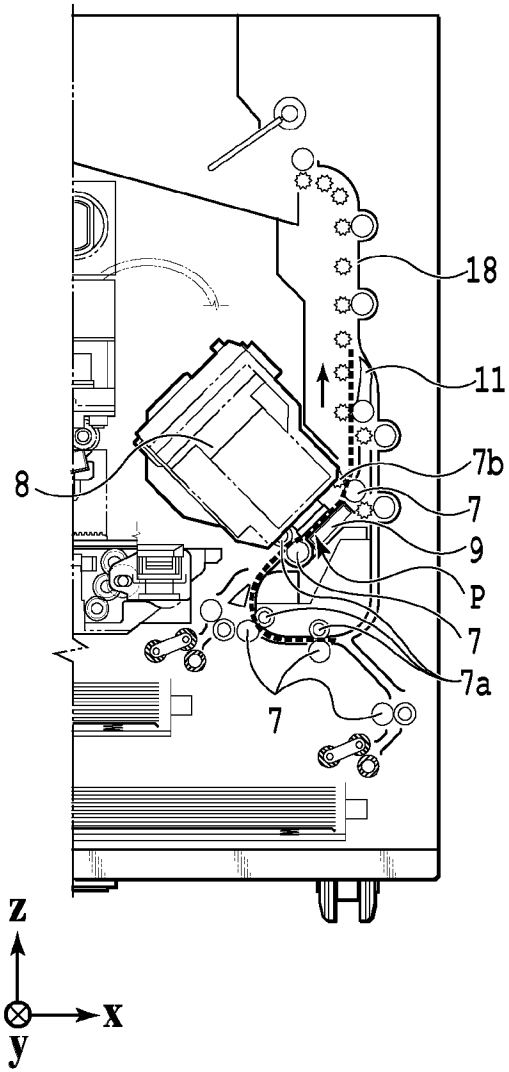
Figure 5A:
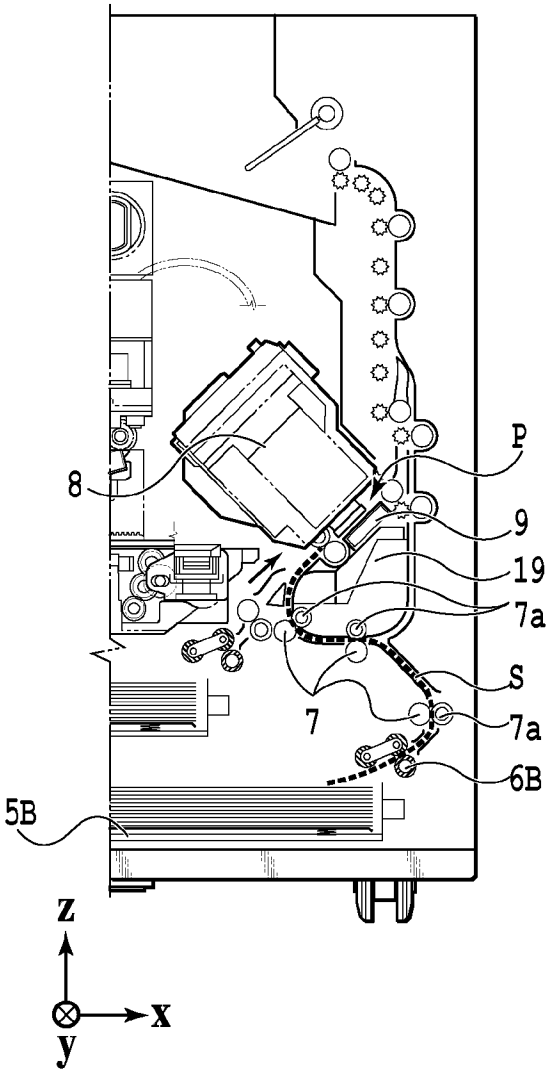

FIGS. 5A to 5C are diagrams showing a conveying path in the case of feeding an A3 size print medium S from the second cassette 5B. A print medium S at the top of a print medium stack in the second cassette 5B is separated from the rest of the stack by the second feeding unit 6B and conveyed toward the print area P between the platen 9 and the print head 8 while being nipped between the conveying rollers 7 and the pinch rollers 7*a*.

FIG. 5A shows a conveying state where the front end of the print medium S is about to reach the print area P. In a part of the conveying path, through which the print medium S is fed by the second feeding unit 6B toward the print area P, the plurality of conveying rollers 7, the plurality of pinch rollers 7*a*, and the inner guide 19 are provided such that the print medium S is conveyed to the platen 9 while being bent into an S-shape.

The rest of the conveying path is the same as that in the case of the A4 size print medium S shown in FIGS. 4B and 4C. FIG. 5B shows a state where the front end of the print medium S has passed through the print area P and the print medium S is being conveyed vertically upward. FIG. 5C shows a state where the front end of the print medium S has passed through the discharging roller 12 and the print medium S is being discharged into the discharging tray 13.

FIGS. 6A to 6D show a conveying path in the case of performing print operation (duplex printing) for the back side (second side) of an A4 size print medium S. In the case of duplex printing, print operation is first performed for the first side (front side) and then performed for the second side (back side). A conveying procedure during print operation for the first side is the same as that shown in FIGS. 4A to 4C and therefore description will be omitted. A conveying procedure subsequent to FIG. 4C will be described below.

Figures 6A, 6B, 6C, 6D:
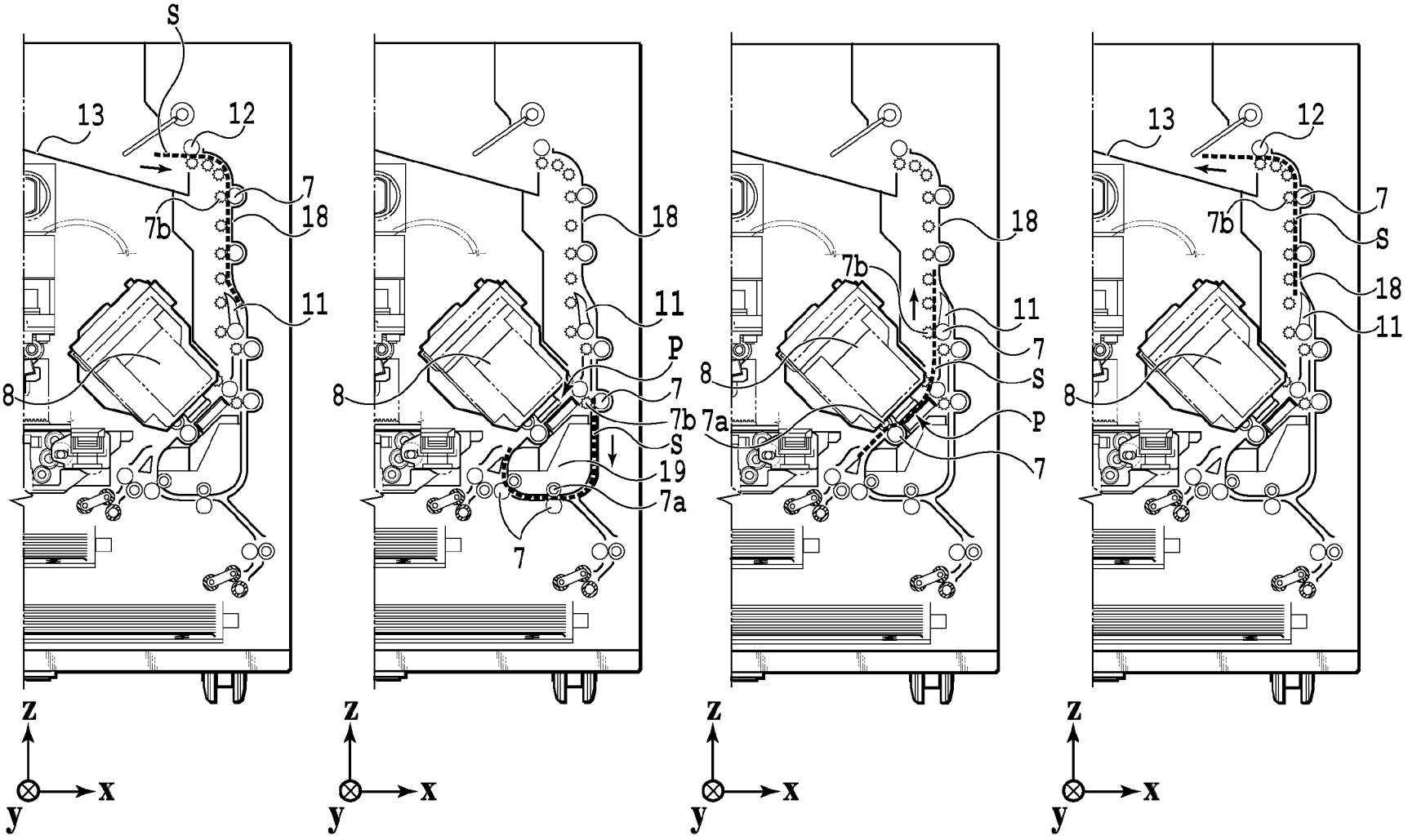
FIGS. 6A to 6D are conveying path diagrams in the case of performing print operation for the back side of a print medium.

After the print head 8 finishes print operation for the first side and the back end of the print medium S passes by the flapper 11, the print controller 202 turns the conveying rollers 7 reversely to convey the print medium S into the printing apparatus 1. At this time, since the flapper 11 is controlled by an actuator (not shown) such that the tip of the flapper 11 is inclined to the left, the front end of the print medium S (corresponding to the back end during the print operation for the first side) passes on the right of the flapper 11 and is conveyed vertically downward. FIG. 6A shows a state where the front end of the print medium S (corresponding to the back end during the print operation for the first side) is passing on the right of the flapper 11.

Then, the print medium S is conveyed along the curved outer surface of the inner guide 19 and then conveyed again to the print area P between the print head 8 and the platen 9. At this time, the second side of the print medium S faces the ejection opening surface 8*a* of the print head 8. FIG. 6B shows a conveying state where the front end of the print medium S is about to reach the print area P for print operation for the second side.

The rest of the conveying path is the same as that in the case of the print operation for the first side shown in FIGS. 4B and 4C. FIG. 6C shows a state where the front end of the print medium S has passed through the print area P and the print medium S is being conveyed vertically upward. At this time, the flapper 11 is controlled by the actuator (not shown) such that the tip of the flapper 11 is inclined to the right. FIG. 6D shows a state where the front end of the print medium S has passed through the discharging roller 12 and the print medium S is being discharged into the discharging tray 13.

Next, maintenance operation for the print head 8 will be described. As described with reference to FIG. 1, the maintenance unit 16 of the present embodiment comprises the cap unit 10 and the wiping unit 17 and activates them at predetermined timings to perform maintenance operation.

Figure 7:
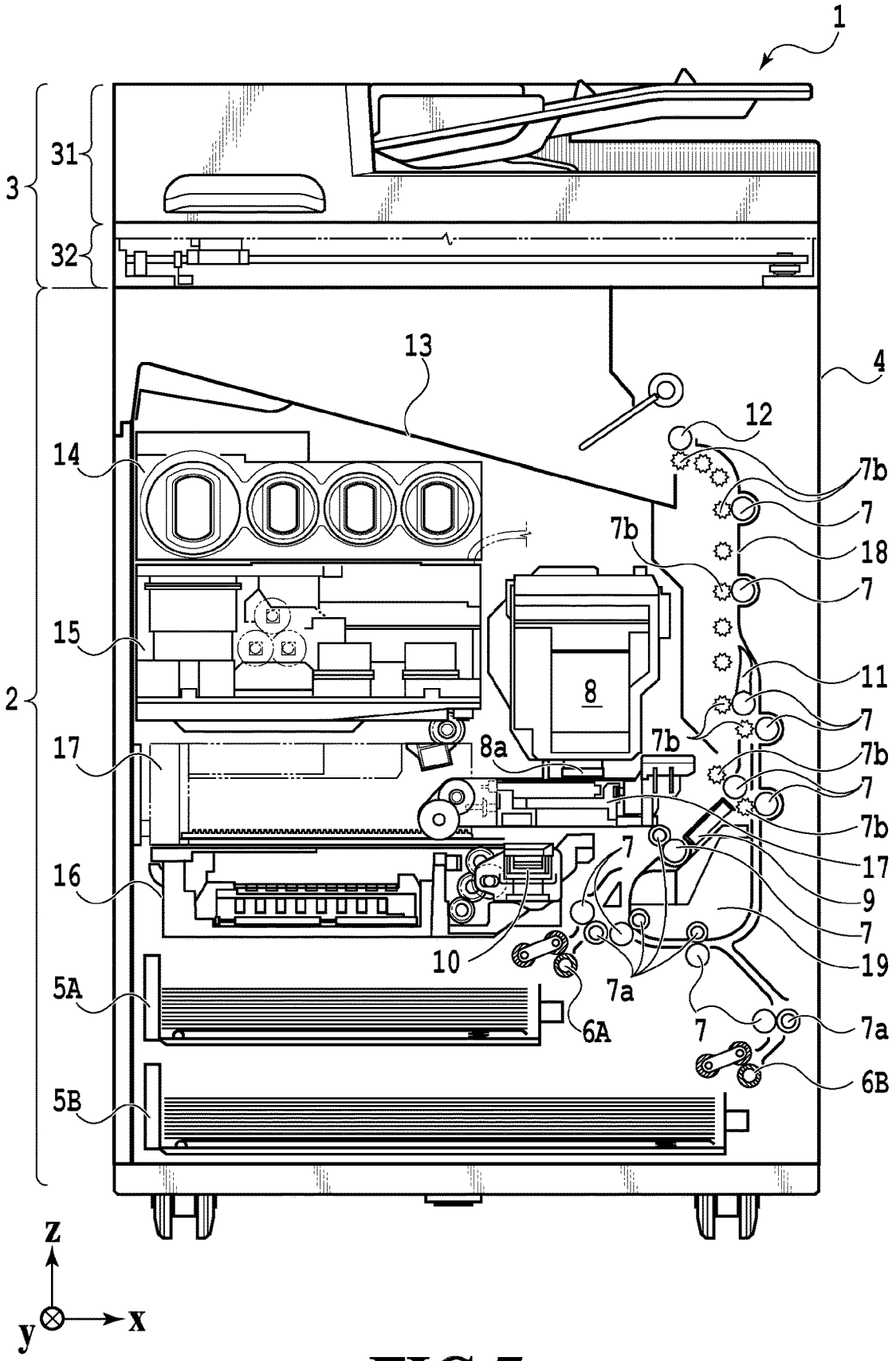
FIG. 7 is a diagram showing the printing apparatus in a maintenance state.

FIG. 7 is a diagram showing the printing apparatus 1 in a maintenance state. In the case of moving the print head 8 from the standby position shown in FIG. 1 to a maintenance position shown in FIG. 7, the print controller 202 moves the print head 8 vertically upward and moves the cap unit 10 vertically downward. The print controller 202 then moves the wiping unit 17 from the evacuation position to the right in FIG. 7. After that, the print controller 202 moves the print head 8 vertically downward to the maintenance position where maintenance operation can be performed.

On the other hand, in the case of moving the print head 8 from the printing position shown in FIG. 3 to the maintenance position shown in FIG. 7, the print controller 202 moves the print head 8 vertically upward while turning it 45°. The print controller 202 then moves the wiping unit 17 from the evacuation position to the right. Following that, the print controller 202 moves the print head 8 vertically downward to the maintenance position where maintenance operation can be performed by the maintenance unit 16.

Figure 8:
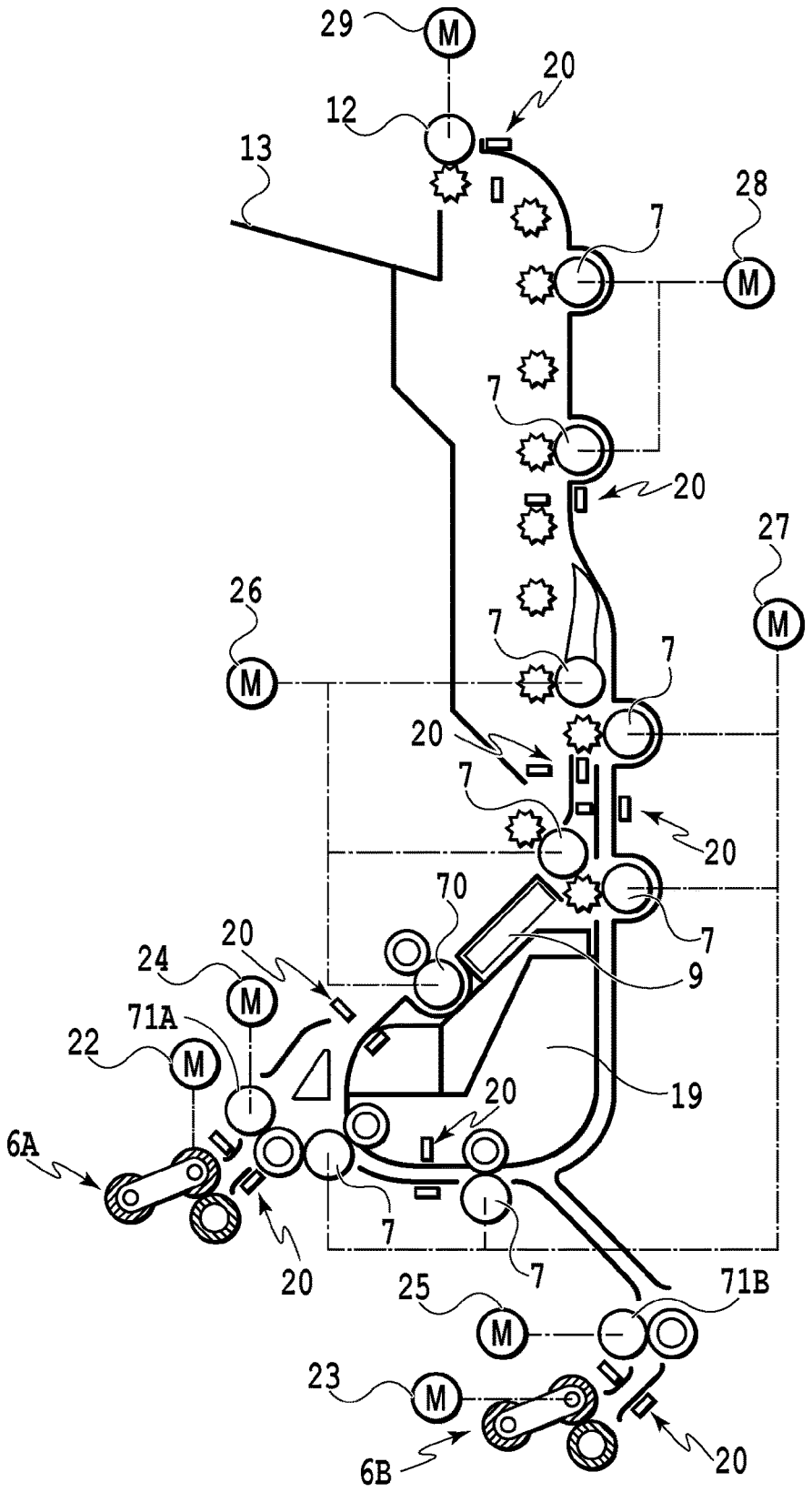
FIG. 8 is a diagram illustrating the association between drive rollers and motors.

FIG. 8 is a diagram illustrating the association between a plurality of motors and the drive rollers in the printing apparatus 1. The first feeding motor 22 drives the first feeding unit 6A, which feeds a print medium S from the first cassette 5A. The second feeding motor 23 drives the second feeding unit 6B, which feeds a print medium S from the second cassette 5B. The first conveying motor 24 drives a first intermediate roller 71A being the first roller to convey the print medium S fed from the first feeding unit 6A. The second conveying motor 25 drives a second intermediate roller 71B being the first roller to convey the print medium S fed from the second feeding unit 6B.

The main conveying motor 26 drives a main conveying roller 70 that is disposed upstream of the platen 9 and mainly conveys a print medium S which is being printed. The main conveying motor 26 also drives the two conveying rollers 7 that are disposed downstream of the platen 9 and convey further downstream the print medium S conveyed by the main conveying roller 70.

The third conveying motor 27 drives the two conveying rollers 7 that convey downward a print medium S printed on the first surface. The third conveying motor 27 also drives the two conveying rollers 7 that are disposed along the inner guide 19 and convey, toward the print head 8, a print medium S fed from the second cassette 5B and conveyed by the second intermediate roller 71B. The third conveying motor 27 also drives the two conveying rollers 7 that convey a print medium S printed on the first surface and flipped upside down toward the print head 8.

A fourth conveying motor 28 drives the two conveying rollers 7 that convey upward or downward a print medium S having finished its print operation. The discharging motor 29 drives the discharging roller 12, which discharges a printed print medium S onto the discharging tray 13. As described above, the two feeding motors 22 and 23, the five conveying motors 24 to 28, and the discharging motor 29 are each associated with one or more drive rollers.

On the other hand, at eight positions along the conveying paths are disposed the sensing members 20, each of which senses the presence or absence of a print medium S. Each sensing member 20 comprises a sensor and a mirror disposed on the opposite sides of the conveying path. The sensor, comprising a light emitting portion and a light receiving portion, is disposed on one side of the conveying path while the mirror is disposed on the other side of the conveying path at a position facing the sensor. Whether a print medium S is present, that is, whether its leading edge or trailing edge is passing, is determined on the basis of whether light emitted from the light emitting portion of the sensor is reflected by the mirror and received by the light receiving portion.

The conveyance control unit 207 controls the conveyance in the entire apparatus by individually driving the feeding motors 22 and 23, the conveying motors 24 to 28, and the discharging motor 29 on the basis of the results of sensing by the plurality of sensing members 20 and the output values of the encoders that detect the amounts of rotation of the respective drive rollers.

<Exterior of Printing Apparatus>

Figure 9:
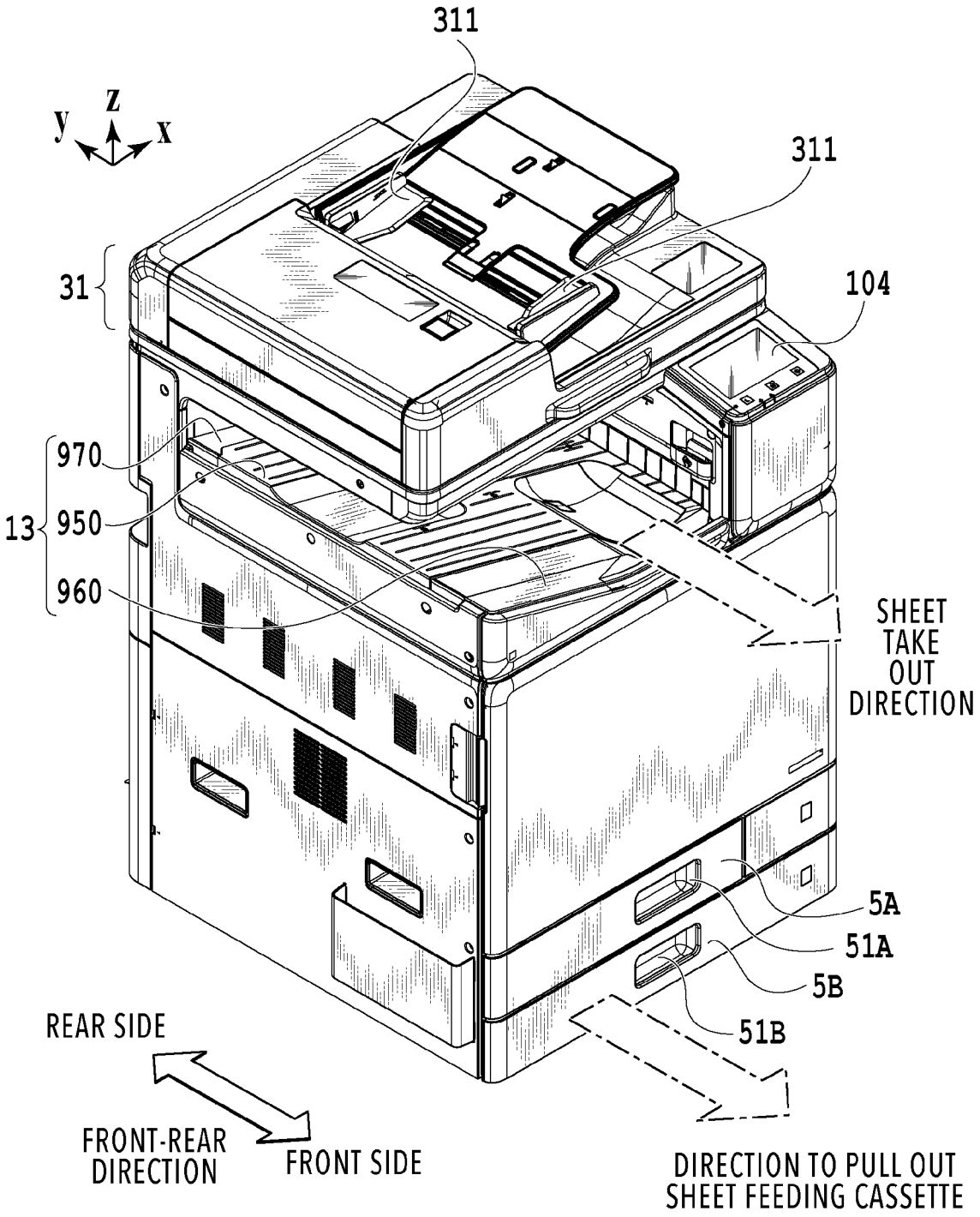
FIG. 9 is an entire perspective view of the printing apparatus.

FIG. 9 is an entire perspective view of the exterior of the printing apparatus 1. The exterior of the printing apparatus 1 will be described using FIGS. 1 and 9. The near side (−y direction side) of FIG. 1 will be referred to as the front side. The far side (+y direction side) of FIG. 1 will be referred to as the rear side. The y-direction will be referred to as the front-rear direction. As illustrated in FIGS. 1 and 9, the scanner unit 3 is provided above the discharging tray 13 of the printing apparatus 1. Thus, in a case of taking out print media placed on the placement surface of the discharging tray 13, the user cannot take out the print media from vertically above the discharging tray 13 since the scanner unit 3 is present. For this reason, the user takes out the print media placed on the discharging tray 13 from a side of the discharging tray 13 in the horizontal direction.

Note that as illustrated in FIG. 1, the placement surface of the discharging tray 13 is a surface inclined such that the side closer to the discharging roller 12 in the discharge direction of print media is lower in the vertical direction and the side farther from the discharging roller 12 is higher in the vertical direction. Thus, the discharging tray 13 receives a print medium S discharged from the discharging roller 12 in a state where the print medium S is inclined relative to the horizontal direction along the discharge direction. Hence, after its trailing edge is released from the nip portion of the discharging roller 12, a print medium S discharged from the discharging roller 12 is caused to move toward the end of the discharging tray 13 on the discharging roller 12 side (the right end in FIG. 1), so that print media S are stacked with their trailing edges aligned with each other. The discharging tray 13 is therefore a surface inclined such that the farther the surface from the discharging roller 12 (discharging unit) in the discharge direction, the higher it is in the vertical direction. Thus, the space above the discharging tray 13 at the farthest end of the discharging tray 13 from the discharging roller 12 (the left surface in FIG. 1) is narrower than the spaces above any other positions on the discharging tray 13 in the discharge direction. The user therefore takes out print media placed on the discharging tray 13 generally by inserting the user's hand horizontally from the front side of the printing apparatus 1. As described above, in the printing apparatus 1 in the present embodiment, its front side is the side where the user takes out print media placed on the discharging tray 13.

As illustrated in FIG. 9, the discharging tray 13 in the present embodiment comprises a movable tray 950, a first fixed tray 960, and a second fixed tray 970. The first fixed tray 960, the movable tray 950, and the second fixed tray 970 are disposed in this order from the front side toward the rear side in FIG. 9. The movable tray 950 is a tray that can be moved in a second direction crossing the discharge direction of print media S (first direction) by the tray motor 990 of the drive unit 211, the second direction being the front-rear direction, which, in the present embodiment, is perpendicular to the first direction. In the present embodiment, the configuration is such that the whole discharging tray 13 does not move but only the movable tray 950 in the discharging tray 13 is movable in the front-rear direction. Details of the configuration of the discharging tray 13 will be described later.

The ADF 31 is provided at the top of the scanner unit 3. The ADF 31 comprises a guide member 311 that guides automatically fed print media. The guide member 311 comprises two members facing each other and is configured such that the distance between the two members in the front-rear direction is adjustable to the width of the print media.

The printing apparatus 1 comprises the first cassette 5A and the second cassette 5B. The first cassette 5A and the second cassette 5B can be pulled in and out in the front-rear direction. A grip portion 51A and a grip portion 51B are provided on the front sides of the first cassette 5A and the second cassette 5B, respectively. In a case of replenishing print media, the user grips the grip portion 51A or the grip portion 51B and pulls it toward the front side to pull out the first cassette 5A or the second cassette 5B. The side from which the user takes out print media placed on the discharging tray 13 is the side where the members (grip portion 51A and grip portion 51B) for use in pulling in and out the sheet feeding units (first cassette 5A and second cassette 5B) are provided, as illustrated in FIG. 9. Note that the members for use in pulling in and out the sheet feeding units are not limited to the grip portions. They may each be an open-close button that, by being pressed, issues an instruction to open or close the sheet feeding unit to the printing apparatus 1.

Also, as illustrated in FIG. 9, the printing apparatus 1 comprises an operating panel 104 on the front side. The user moves to the front side of the printing apparatus 1 and operates the operating panel 104 to enter various instructions to the printing apparatus 1.

As described above, the user is expected to perform various operations and actions on the printing apparatus 1 mainly from its front side. Then, if print media placed on the discharging tray 13 are moved to a position close to the front side, it is possible to improve the ease of taking out the print media for the user. In the present embodiment, a description will be given of a mode that improves the ease of taking out print media.

<Configuration of Discharging Tray>

Figure 10C:
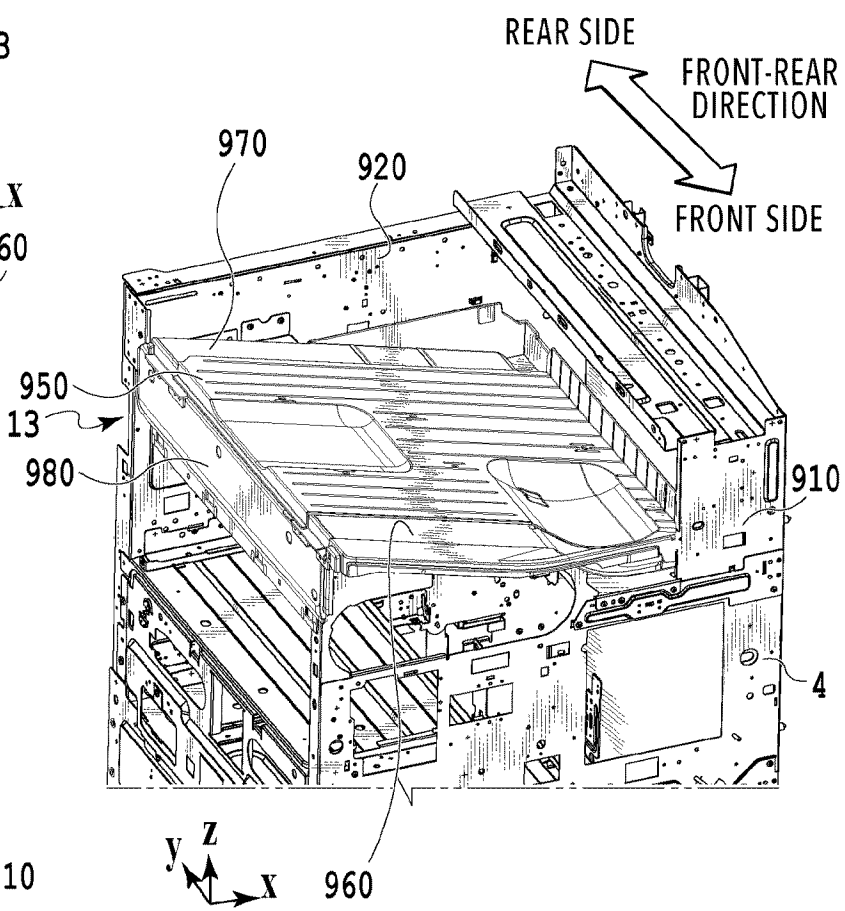
FIGS. 10A to 10C are diagrams explaining the configuration of a discharging tray.
Figure 10B:
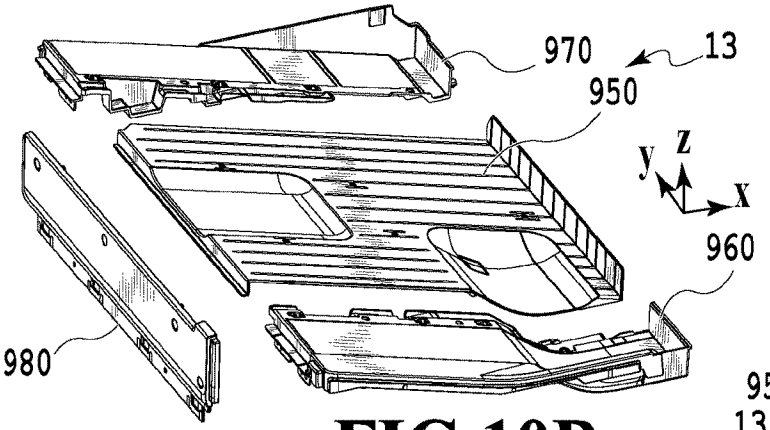
Figure 10A:
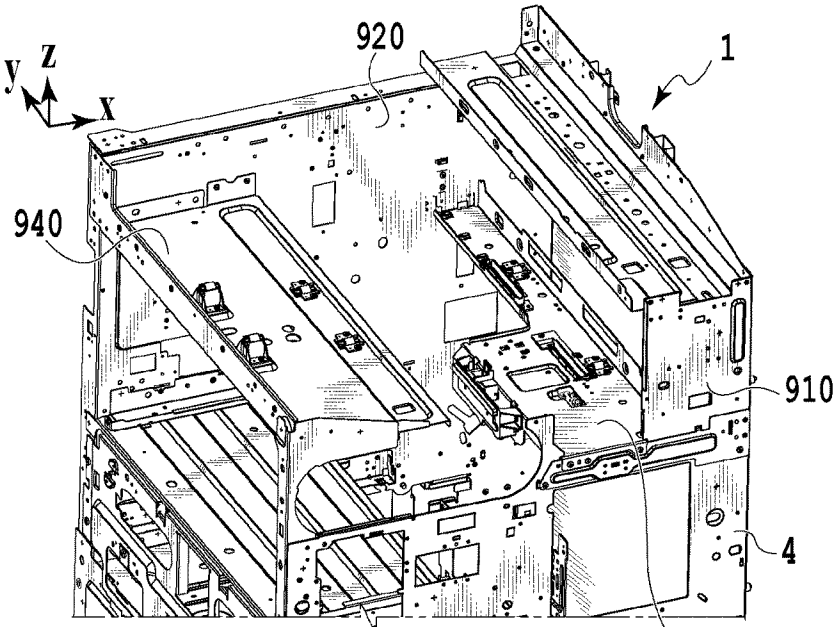

FIGS. 10A to 10C are diagrams explaining the configuration of the discharging tray 13. FIG. 10A is a diagram of the printing apparatus 1 without the discharging tray 13 installed thereon. The casing 4 of the printing apparatus 1 comprises a first side plate 910 on the front side and a second side plate 920 on the rear side. The first side plate 910 and the second side plate 920 are made of sheet metal and ensure that the entire printing apparatus 1 has sufficient rigidity. Also, a first frame 930 and a second frame 940 which are also made of sheet metal and have surfaces parallel to a horizontal plane are fixed to the first side plate 910 and the second side plate 920 so as to join them to each other. The discharging tray 13 in the present embodiment is mounted between the first side plate 910 and the second side plate 920 on the first frame 930 and the second frame 940, which are laid between them.

FIG. 10B is an exploded diagram illustrating the configuration of the discharging tray 13. The discharging tray 13 comprises the movable tray 950, the first fixed tray 960, the second fixed tray 970, and a tray side cover 980.

In assembling the apparatus, first, the first fixed tray 960 and the second fixed tray 970 are mounted to link the first frame 930 and the second frame 940 on the main body. In this step, the first fixed tray 960 is disposed on the front side and fixed to the first side plate 910. The second fixed tray 970 is disposed on the rear side and fixed to the second side plate 920.

Then, the movable tray 950 is mounted to link the first frame 930 and the second frame 940. In this step, the movable tray 950 is mounted on the first fixed tray 960 and the second fixed tray 970 so as to overlap them in the front-rear direction and cover the gap between the first fixed tray 960 and the second fixed tray 970 in the front-rear direction. After the first fixed tray 960, the second fixed tray 970, and the movable tray 950 are thus mounted, the tray side cover 980 is attached. As a result, the discharging tray 13 as illustrated in FIG. 10C is completed.

As illustrated in FIG. 10C, the discharging tray 13 is inclined such that an upstream side in the discharge direction (right side in FIG. 10C) is lower than a downstream side in the discharge direction. This is because the second frame 940, which is located downstream, is disposed at a higher position in the vertical direction than the first frame 930, which is located upstream. The movable tray 950 is configured to be movable in the front-rear direction within a range within which the movable tray 950 has overlapping regions over the first fixed tray 960 and the second fixed tray 970 in the vertical direction.

Figure 11:
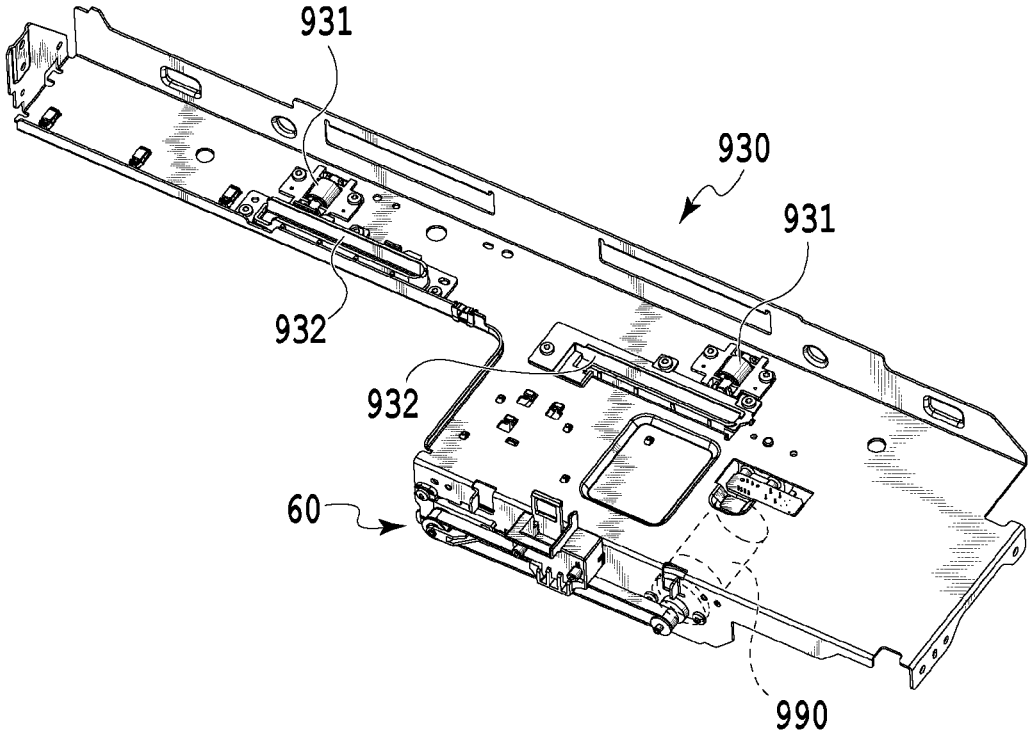
FIG. 11 is an enlarged perspective view of a first frame.

FIG. 11 is an enlarged perspective view of the first frame 930. As illustrated in FIG. 11, on the first frame 930 are disposed first support members 931 and guide members 932 that contact the back surface of the movable tray 950. A roller that assists movement of the movable tray 950 is attached to each first support member 931. Each guide member 932 is a groove extending in the width direction of conveyed print medium and guides movement of the movable tray 950. The first frame 930 is also provided with a drive transmission unit 60 that transmits drive force of the tray motor 990, which is disposed on the back side of the frame, to the movable tray 950.

Figure 12:
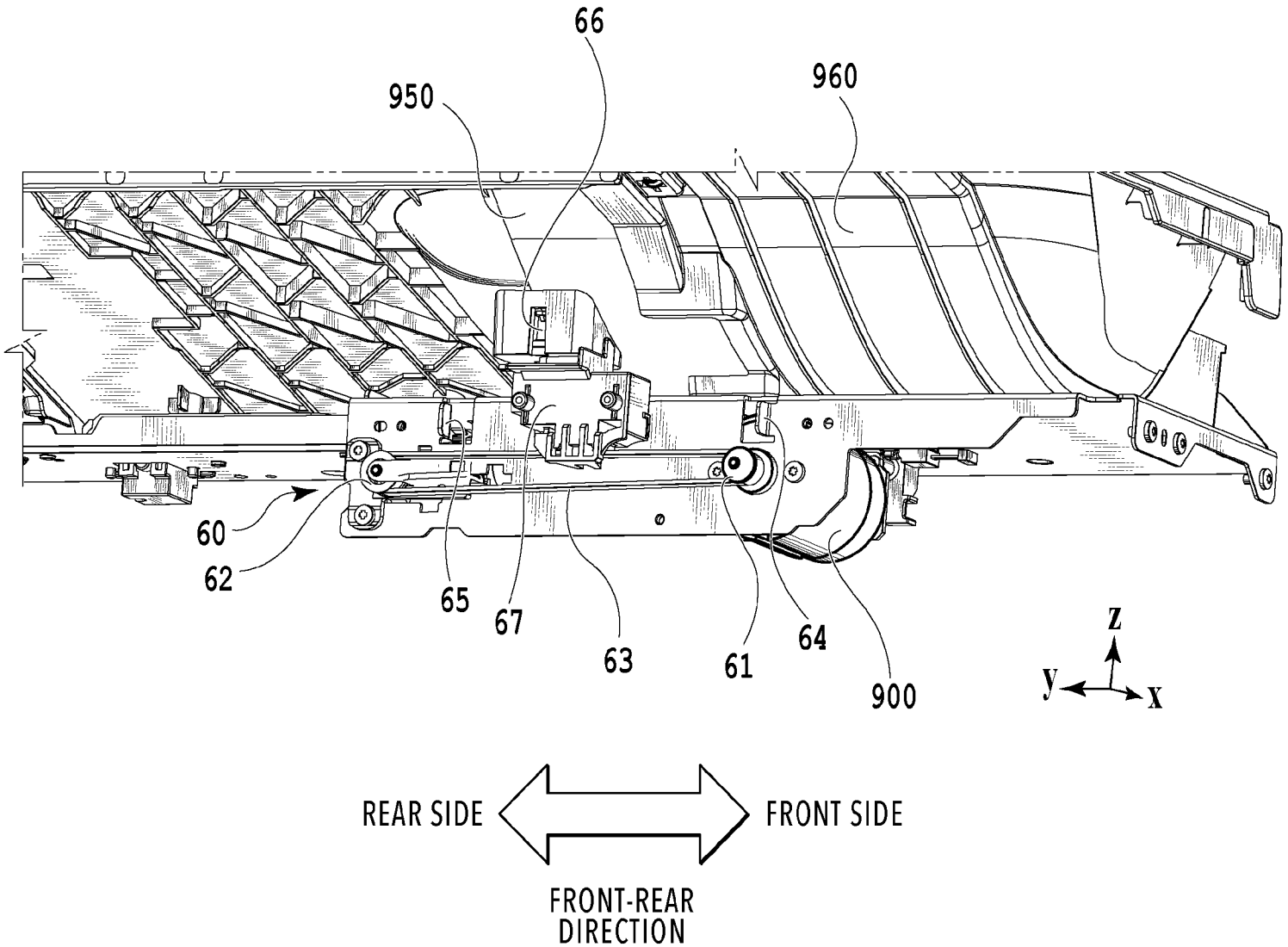
FIG. 12 is a diagram illustrating an example where a movable tray is mounted to a drive transmission unit.

FIG. 12 is a diagram illustrating an example where the movable tray 950 is mounted to the drive transmission unit 60. The drive transmission unit 60 comprises a pulley 61, an idler pulley 62, a belt 63, a drive transmission member 67, and a movable tray joint 66. The pulley 61 is fixed to the output shaft of the tray motor 990, which is a DC motor. The idler pulley 62 is disposed on the opposite side from the pulley 61 (rear side) in FIG. 12. The belt 63 is an endless belt and stretched between the pulley 61 and the idler pulley 62. The drive transmission member 67 is attached to a straight portion of the belt 63. The drive transmission member 67 comprises the movable tray joint 66. The movable tray 950 is joined to the movable tray joint 66. With this configuration, rotating the tray motor 990 forward and backward causes the drive transmission member 67 to move forward and backward. Thus, as the drive transmission member 67 is driven, the movable tray 950, joined to the movable tray joint 66 of the drive transmission member 67, correspondingly moves in the front-rear direction toward the front side and the rear side. Since the drive transmission unit 60 uses the belt 63, as described above, the amount of movement of the movable tray 950 is larger than cases where the drive transmission unit 60 uses other mechanisms. In the example described here, the tray motor 990 is a DC motor. Note however that the tray motor 990 may be a pulse motor (PM) or the like. Instead of the belt 63, the drive transmission unit 60 may use, for example, a mechanism that moves the movable tray 950 forward and backward by means of rotations of a cam, or the like. Alternatively, the drive transmission unit may be configured using a rack and pinion.

In the front-rear direction in which the drive transmission member 67 moves forward and backward, a front-side contact portion 64 is provided which the drive transmission member 67 contacts. A rear-side contact portion 65 is provided on the opposite side from the front-side contact portion 64. In the present embodiment, the conveyance control unit 207 can detect the amount of relative movement of the movable tray 950 (hereinafter referred to as "relative movement amount") corresponding to the amount of rotation of the tray motor 990. However, the conveyance control unit 207 cannot figure out the absolute position of the movable tray 950 only from the relative movement amount. To figure out the absolute position of the movable tray 950, the conveyance control unit 207 needs to figure out a reference position (origin information). The front-side contact portion 64 and the rear-side contact portion 65 are used to figure out this origin information. Details will be described later.

<Discharge Positions of Discharged Print Media>

Next, the discharge positions of print media discharged onto the discharging tray 13 (movable tray 950) will be described. First, a mode in which the discharging tray 13 is not movable will be described as a comparative example. Then, a mode in which the discharging tray 13 moves to provide two discharge positions will be described. Thereafter, a sheet take-out position provided by the movable tray 950 in the present embodiment will be described.

Figure 13:
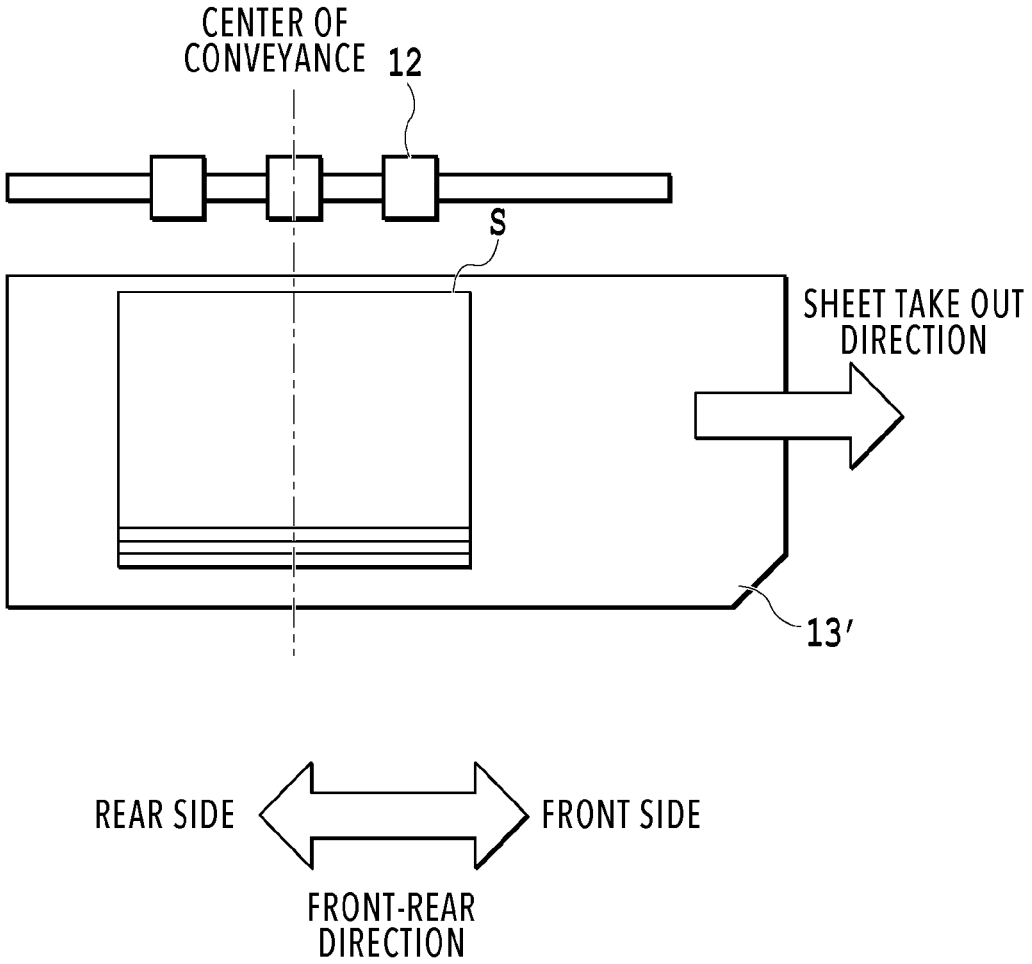
FIG. 13 is a diagram illustrating a comparative example.

FIG. 13 is a diagram explaining a mode using an immovable discharging tray 13' as a comparative example. Print media S discharged from the discharging roller 12 are placed on the immovable discharging tray 13' as a pile of print media. As mentioned earlier, the user takes out the placed pile of print media S from the front side. When taking out the placed pile of print media S, the closer the pile of print media S is to the front side, the easier it is for the user to take out the placed pile of print media S.

Figure 14:
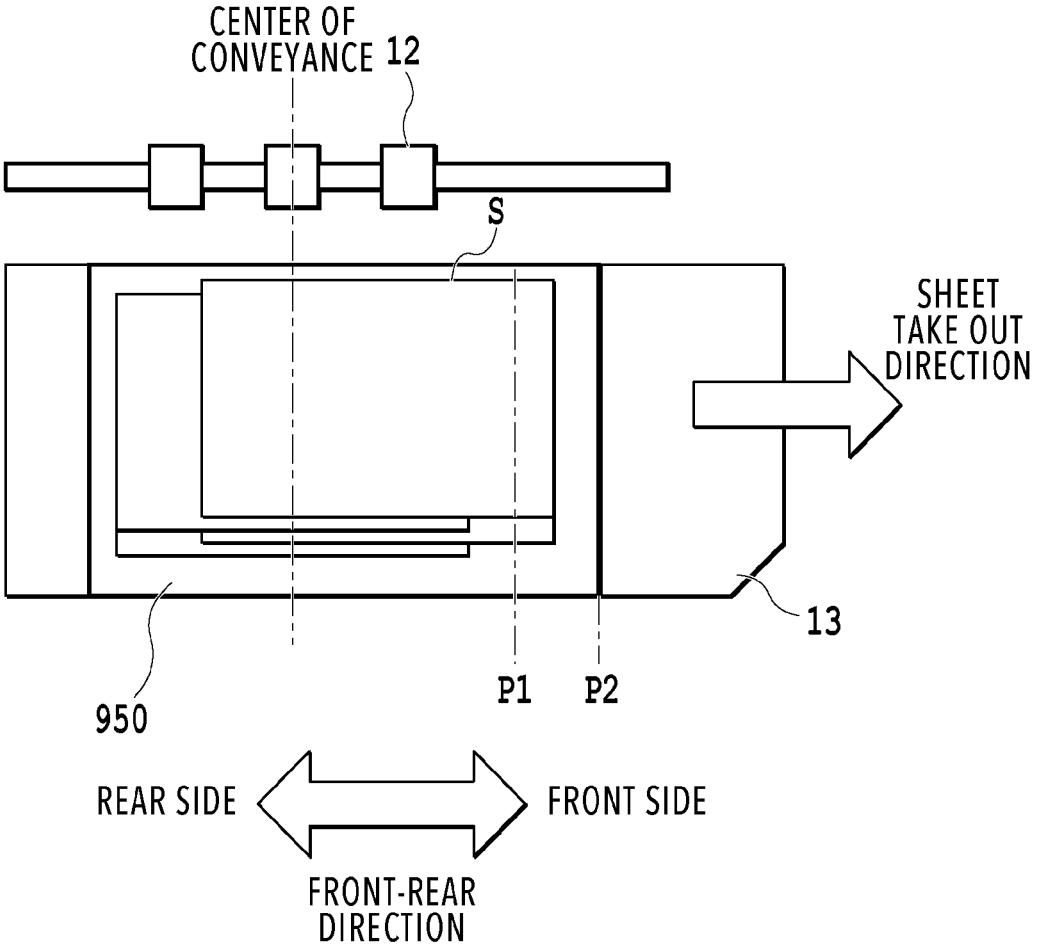
FIG. 14 is a diagram explaining discharge positions.

FIG. 14 is a diagram illustrating an example with the discharging tray 13, which comprises the movable tray 950. Discharge positions on the movable tray 950 will be described using FIG. 14. In the present embodiment, in a case where the print command includes an instruction to sort print media, the conveyance control unit 207 drives the conveying motors 24 to 28 and the discharging motor 29 to convey print media while also driving the tray motor 990. Specifically, the conveyance control unit 207 moves the movable tray 950 to a plurality of discharge positions set along the front-rear direction in synchronization with the discharge timings of the plurality of print media. As a result, the plurality of print media S discharged from the discharge port are sorted and stacked at a plurality of different positions in the front-rear direction on the movable tray 950. FIG. 14 illustrates an example where the movable tray 950 is moved to two discharge positions, namely, a rear-side discharge position P1 and a front-side discharge position P2. Each of the rear-side discharge position P1 and the front-side discharge position P2 represents the position of the front-side end of the movable tray 950. In the case where the movable tray 950 is located at the rear-side discharge position P1, a pile of print media S discharged is placed on the front side of the movable tray 950. In the case where the movable tray 950 is located at the front-side discharge position P2, a pile of print media discharged is placed on the rear side of the movable tray 950.

A specific example of the sorting will be described. In a case of printing a plurality of jobs each containing a set of five sheets, for example, the first set is discharged with the movable tray 950 at a first position (any one of the rear-side discharge position P1 or the front-side discharge position P2). Also, the second set is discharged with the movable tray 950 at a second position (the rear-side discharge position P1 or the front-side discharge position P2) different from the first position. The third set is discharged with the movable tray 950 at the first position, the fourth set is discharged with the movable tray 950 at the second position, and the fifth set is discharged with the movable tray 950 at the first position. Another example will be described. A print medium printed in accordance with a first command is discharged onto the movable tray 950 at the first position. In a case where the printing apparatus 1 subsequently receives a second command, the corresponding print medium will be discharged with the movable tray 950 located at the second position.

Here, assume that the possible range of movement of the movable tray 950 corresponds to the positions at which to place discharged print media. Specifically, assume that the possible range of movement of the movable tray 950 in the example of FIG. 14 is between the rear-side discharge position P1 and the front-side discharge position P2. Assume also that, to make it easier for the user to take out discharged print media, the movable tray 950 is moved to the front-side discharge position P2, which is the closest position to the front side which the movable tray 950 can be moved to, after the discharge is completed. In this case, a pile of print media S discharged at the rear-side discharge position P1 moves toward the front side from the position at which they were discharged. This improves the ease of taking out the pile of print media S discharged at the rear-side discharge position P1. However, the position of a pile of print media S discharged at the front-side discharge position P2 is the same as the position at which they were discharged. Thus, a mode as illustrated in FIG. 14 cannot improve the ease of taking out piles of discharged print media S as a whole.

Figure 15:
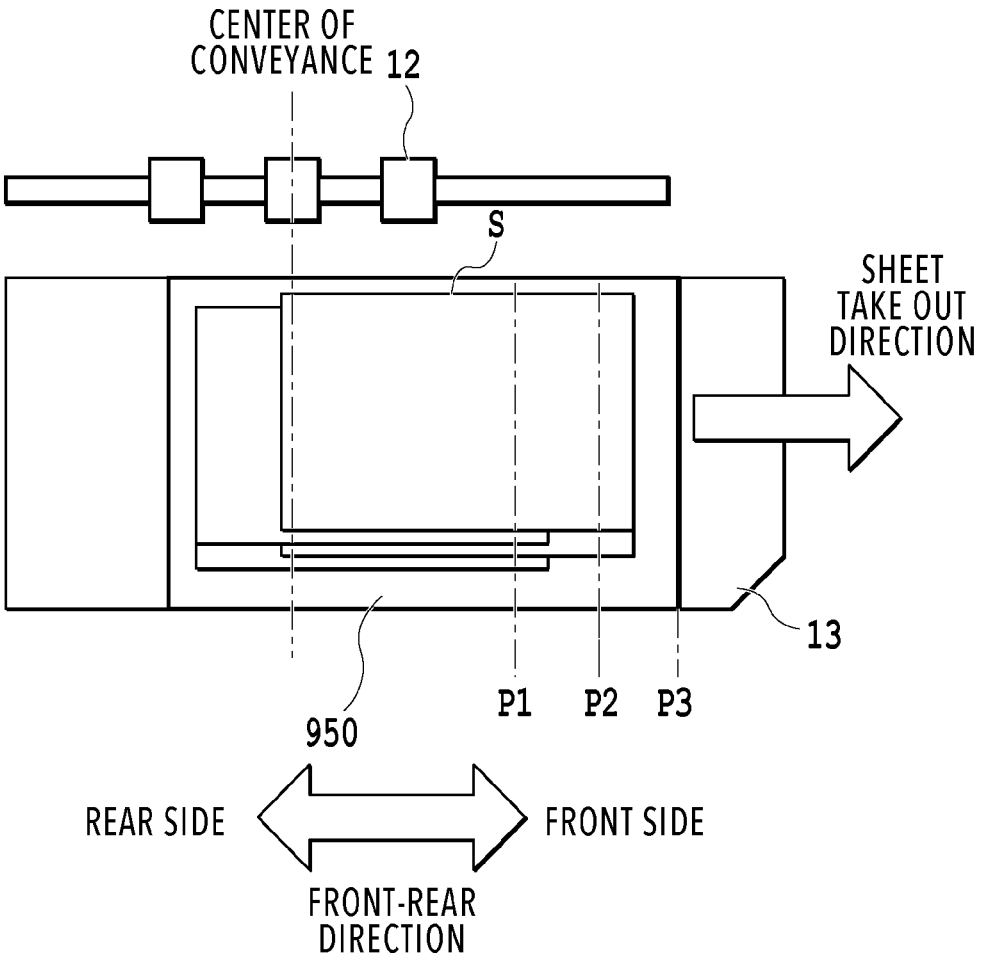
FIG. 15 is a diagram explaining a sheet take-out position.

FIG. 15 is a diagram explaining a sheet take-out position provided by the movable tray 950 in the present embodiment. In the present embodiment, as illustrated in FIG. 15, the movable tray 950 is moved to receive thereon print media at a plurality of discharge positions. After the discharge is completed, the conveyance control unit 207 moves the movable tray 950 to a sheet take-out position P3 which is not used as a discharge position and is located closer to the front side in the front-rear direction than any discharge positions. The sheet take-out position P3 in FIG. 15 represents the position of the front-side end of the movable tray 950. Thus, according to the present embodiment, the piles of print media S, discharged at the rear-side discharge position P1 and the front-side discharge position P2, are moved as a whole toward the front side. This improves the ease of taking out piles of print media S discharged at all discharge positions as a whole.

The examples of FIGS. 14 and 15 have been described taking as an example a case where the movable tray 950 has two discharge positions, but the number of discharge positions is not limited to the above. The movable tray 950 may have three or more discharge positions. It suffices that the movable tray 950 is movable to the sheet take-out position P3, which is closer to the front side in the front-rear direction than any discharge positions, which are used when print media are discharged. The sheet take-out position P3 in FIG. 15 is a position not used during discharge (i.e. a position which the movable tray 950 does not move to during discharge). Thus, print media discharge at any discharge positions will be moved closer to the front side than when they were discharged.

In the example of FIG. 15 described, in a case where the print command includes an instruction to sort print media, the movable tray 950 is moved in the front-rear direction by a predetermined amount and, after the sorting is completed, the movable tray 950 is moved to the sheet take-out position P3. Note however that the movable tray 950 may be moved to the sheet take-out position P3 also in a case where the print command does not include an instruction to sort print media. In other words, even in a case of not sorting print media, the conveyance control unit 207 may move the movable tray 950 to the sheet take-out position P3 after the discharge is completed. Also, the user may operate the operating panel 104 in advance to set whether or not to move the movable tray 950 to the sheet take-out position P3, and the conveyance control unit 207 may control whether or not to move the movable tray 950 to the sheet take-out position P3 on the basis of the setting.

<Control of Amount of Movement of Movable Tray 950>

Figure 16A:
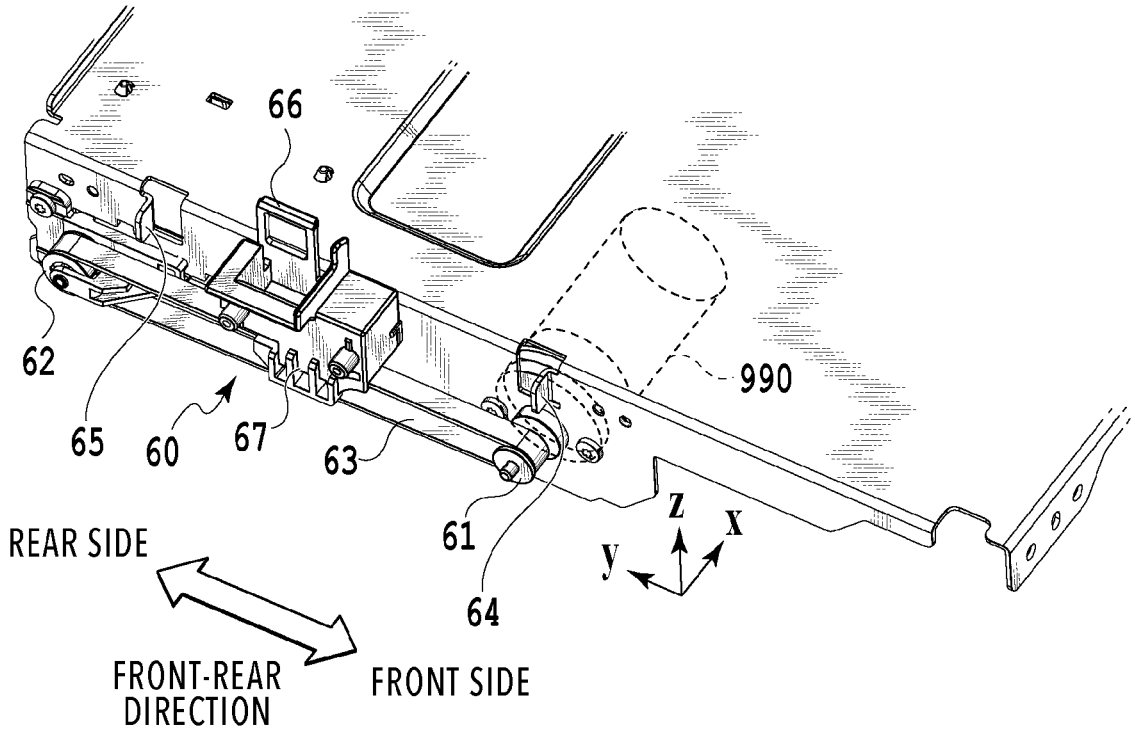
FIGS. 16A to 16C are diagrams explaining control of the amount of movement of the movable tray.
Figure 16B:
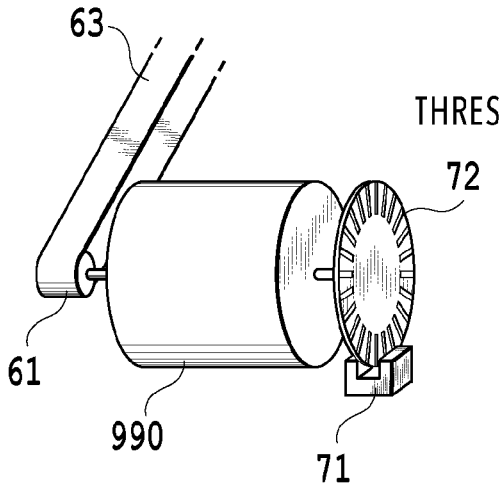
Figure 16C:
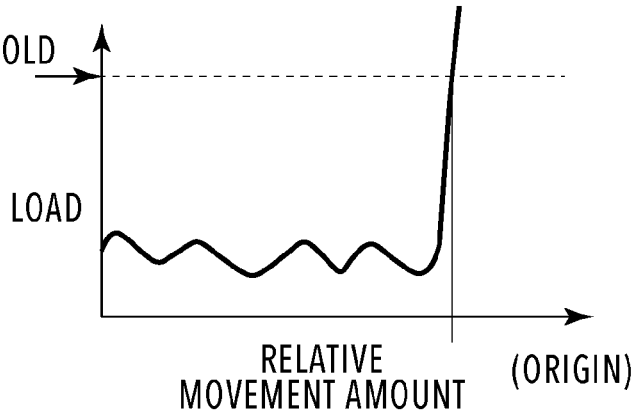

FIGS. 16A to 16C are diagrams explaining the control of the amount of movement of the movable tray 950. FIG. 16A is a diagram explaining the drive transmission unit 60, which has been illustrated in FIG. 12. In FIG. 16A, illustration of the movable tray 950 is omitted for the sake of explanation. As mentioned earlier, the movable tray 950 moves as the drive transmission member 67, disposed on a straight portion of the belt 63, moves in the front-rear direction. Here, to control the movable tray 950 (i.e. drive transmission member 67) as intended, the conveyance control unit 207 needs to constantly figure out the absolute position of the drive transmission member 67. In the present embodiment, a description will be given of a mode, as a configuration that can obtain the absolute position at low cost, in which the conveyance control unit 207 obtains the absolute position by obtaining the relative movement amount from a reference position. In the present embodiment, the front-side contact portion 64 or the rear-side contact portion 65 is set as the reference position. The conveyance control unit 207 obtains the relative movement amount of the drive transmission member 67 from the amount of rotation of the tray motor 990 after sensing that the reference position is reached. Using the relative movement amount from the reference position, the conveyance control unit 207 can obtain the absolute position of the drive transmission member 67, that is, the absolute position of the movable tray 950.

FIG. 16B is a diagram explaining the tray motor 990, a code wheel 72, and an encoder 71. The code wheel 72 is attached to the tray motor 990. The code wheel 72 is a disc with marks given at predetermined intervals in the direction of rotation of the tray motor 990. The encoder 71 is disposed to be capable of reading the marks on the code wheel 72. The encoder 71 counts the number of marks on the code wheel 72 passing the encoder 71 to obtain the amount of rotation of the tray motor 990. Since the amount of rotation of the tray motor 990 and the amount of movement of the movable tray 950 (i.e. drive transmission member 67) correspond to each other, it is possible to figure out the absolute position of the movable tray 950 by figuring out its relative movement amount from the reference position. Note that the amount of movement may be figured out using the number of input pulses from a stepper motor, on-off signals from a sensor, or the like.

FIG. 16C is a diagram explaining an example of how to determine the reference position. In the present embodiment, the conveyance control unit 207 detects that the drive transmission member 67 has come into contact with the front-side contact portion 64 or the rear-side contact portion 65, to thereby determine the reference position (origin position). The conveyance control unit 207 detects the contact by detecting a change in the load on the tray motor 990. The conveyance control unit 207 can determine the occurrence of the change in the load from the torque, the current value, the amount of movement per unit time, or the like. For example, the conveyance control unit 207 can determine the point in FIG. 16C at which the load on the motor exceeds the contact threshold as the position at which the contact is detected and determine it as the reference position (origin position).

As described above, in the present embodiment, the front-side contact portion 64 and the rear-side contact portion 65 are provided, and basically the drive transmission member 67 may be brought into contact with one of the contact portions to determine the reference position. In the present embodiment, however, to shorten the print time, the front-side contact portion 64 is used to determine the reference position. As described with reference to FIG. 15, in the present embodiment, the movable tray 950 is moved to be closer to the front side in the front-rear direction than are any discharge positions to thereby be at the sheet take-out position P3. For this reason, the position at which the movable tray 950 is stopped as a result of such movement control corresponds to the sheet take-out position P3. In a case where the movable tray 950 is then to be moved, the above-described process of determining the reference position is performed. This is because the position of the movable tray 950 may have been shifted by an external force or the like. For example, an external force such as vibration of the environment in the apparatus is installed or a user operation may possibly be exerted on the discharging tray. It is also possible that, after the control is finished, the tray motor 990 may rotate due to cogging of the motor or the like, thereby moving the movable tray 950. For these reasons, the process of determining the reference position is performed in a case where the movable tray 950 transitions from a non-moving state to a moving state, e.g. in a case where a print job is received.

In the present embodiment, the process of determining the reference position is performed using the front-side contact portion 64, with which the amount of movement of the movable tray 950, located at the sheet take-out position P3, is smaller. Such control shortens the time to be taken to determine the reference position as compared to a case where the reference position is determined using the rear-side contact portion 65. Thus, the reference position is determined without significantly affecting the print time.

Note that the method of determining the reference position is not limited to this example. For example, a light blocking plate may be provided to the movable tray 950, a photo-interrupter or the like may be used to detect that the light blocking plate has passed a predetermined position (origin position) of the movable tray 950, and the position at which this passage is detected may be determined as the reference position (origin position). A different method such as an electric or magnetic method may be used as long as it can detect passage at the predetermined position.

<Foreign Substance Detection Process>

Figure 17:
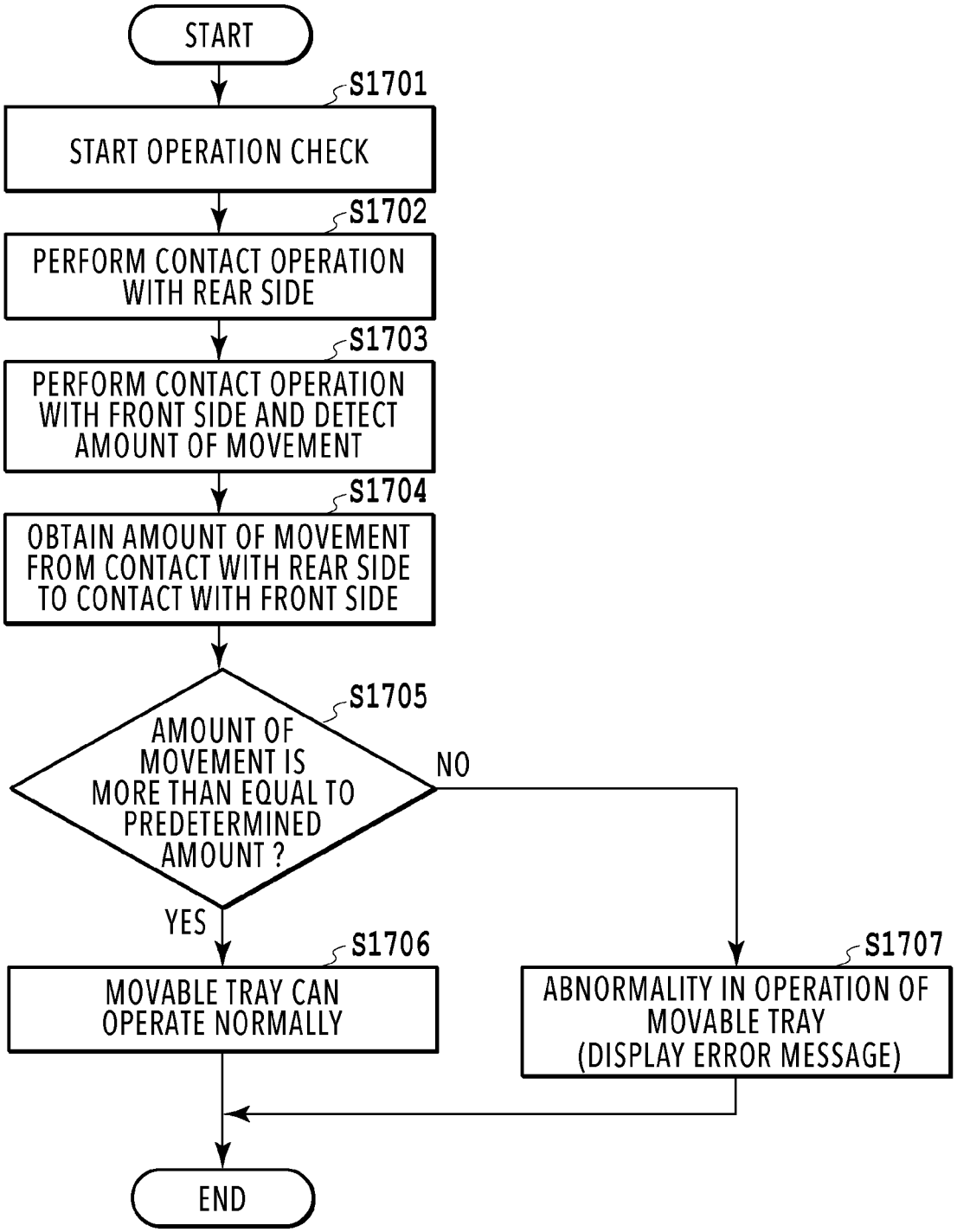
FIG. 17 illustrates an example flowchart.

FIG. 17 illustrates an example flowchart of a foreign substance detection process. In the present embodiment, the rear-side contact portion 65 is provided as well as the front-side contact portion 64. Providing contact portions on both the rear side and the front side in the front-rear direction as above enables an operation check of the movable tray 950. Since the movable tray 950 is provided as an exterior part of the printing apparatus 1, there is a possibility that a foreign substance or the like may get into the possible region for movement of the movable tray 950. If a foreign substance gets in, the movable tray 950 may possibly fail to make the proper amount of operation. For this reason, it is desirable to check the operation of the movable tray 950 with a predetermined timing. The predetermined timing is, for example, a timing such as when the apparatus is powered on or after the apparatus resumes from sleep. In the present embodiment, an operation performed with a timing such as when the apparatus is powered on or after the apparatus resumes from sleep will be referred to as "initializing operation". FIG. 17 is a diagram illustrating an example of the foreign substance detection process performed by the conveyance control unit 207 for the initializing operation other than printing operations. Meanwhile, the symbol "S" in the description of each process means a step in the flowchart.

In S1701, the conveyance control unit 207 starts an operation check of the movable tray 950 in response to an instruction from the controller unit 100. In S1702, the conveyance control unit 207 performs a contact operation using the rear-side contact portion 65. Specifically, the conveyance control unit 207 rotationally drives the tray motor 990 to move the drive transmission member 67 toward the rear-side contact portion 65, and determines that the drive transmission member 67 has come into contact with the rear-side contact portion 65 when the load on the motor exceeds a threshold.

In S1703, the conveyance control unit 207 performs a contact operation using the front-side contact portion 64. Specifically, the conveyance control unit 207 drives the tray motor 990 in the reverse direction to move the drive transmission member 67 toward the front-side contact portion 64, and determines that the drive transmission member 67 has come into contact with the front-side contact portion 64 when the load on the motor exceeds the threshold.

In S1704, the conveyance control unit 207 obtains the amount of movement of the drive transmission member 67 from the contact with the rear-side contact portion 65 to the contact with the front-side contact portion 64. In S1705, the conveyance control unit 207 determines whether or not the amount of movement is more than or equal to a predetermined amount. If the amount of movement is more than or equal to the predetermined amount, the flow proceeds to S1706, in which the conveyance control unit 207 determines that the movable tray 950 has moved normally.

On the other hand, if the amount of movement is less than the predetermined amount, there is a possibility that a foreign substance may have been caught in the region for movement of the movable tray 950 or a similar event may have occurred, thereby preventing the movable tray 950 from moving. Then, the flow proceeds to S1707, in which the conveyance control unit 207 notifies the controller unit 100 that abnormality has occurred. The controller unit 100 notifies the user that the operation of the movable tray 950 is abnormal.

Figure 18:
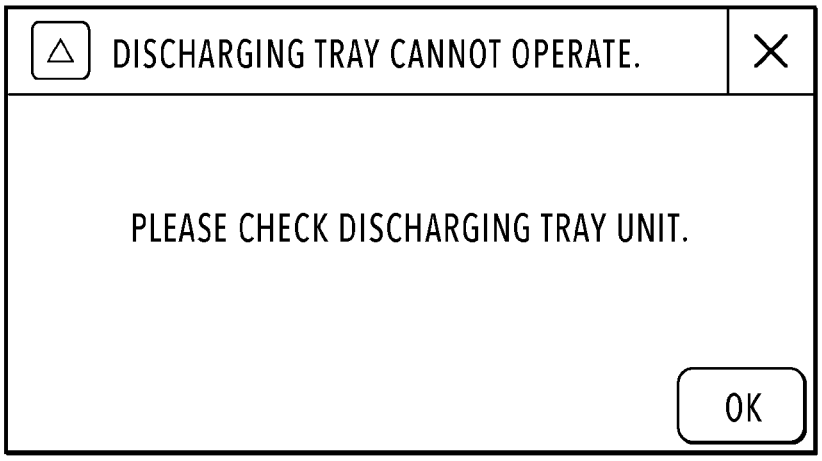
FIG. 18 is a diagram illustrating an example display window.

FIG. 18 is an example message displayed in S1707. In S1707, the controller unit 100 displays an error message on the operating panel 104 of the printing apparatus 1 or a screen of the host apparatus 400 to prompt the user to check the discharging tray 13. In this way, the movable tray can be brought back to the normal operation by a user action such for example as removing the foreign substance present in the region for the operation of the movable tray.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

According to the present disclosure, it is possible to improve the ease of taking out piles of sorted sheets as a whole.

What is claimed is:

1. A printing apparatus comprising:

a discharging unit configured to discharge print media;

a tray configured to receive print media discharged in a first direction from the discharging unit;

a drive unit configured to move the tray in a second direction crossing the first direction;

a drive transmission unit configured to be joined to the tray and to be used for transmitting drive of the drive unit to the tray;

a contact portion to which the drive transmission unit contacts as the drive transmission unit is moved in the second direction;

a detecting unit configured to detect an amount of relative movement of the tray; and a control unit configured to control the drive unit, wherein in discharging print media by the discharging unit, the tray is moved in the second direction to thereby receive the discharged print media at a plurality of different positions on the tray, and the control unit controls the drive unit on a basis of a reference position determined by the contact portion and the amount of relative movement.

2. The printing apparatus according to claim 1, wherein the drive unit moves the tray to the take-out position after a sorting is finished.

3. The printing apparatus according to claim 1, further comprising a scanner unit above the tray in a vertical direction.

4. The printing apparatus according to claim 1, further comprising a sheet feeding unit provided below the tray in a vertical direction and configured to feed the print media, wherein the second direction is a same direction as a direction in which the sheet feeding unit is pulled out.

5. The printing apparatus according to claim 4, wherein the take-out side where print media are taken out is a side where a member for pulling out the sheet feeding unit is provided.

6. The printing apparatus according to claim 1, further comprising an operating panel, wherein the take-out side where print media are taken out is a side where the operating panel is provided.

7. The printing apparatus according to claim 1, wherein the drive unit comprises a motor and a belt, and the drive transmission unit is disposed on a straight portion of the belt.

8. The printing apparatus according to claim 1, wherein the contact portion comprises a front-side contact portion disposed on the take-out side in the second direction and a rear-side contact portion disposed on an opposite side from the take-out side in the second direction, and the control unit determines the reference position by causing the drive unit to perform an operation of bringing the drive transmission unit into contact with the front-side contact portion.

9. The printing apparatus according to claim 8, wherein the control unit performs the operation of bringing the drive transmission unit into contact with the front-side contact portion to determine the reference position in response to an instruction to perform a print operation.

10. The printing apparatus according to claim 9, wherein in response to an instruction to perform an initializing operation other than the print operation, the control unit causes the drive unit to perform an operation of bringing the drive transmission unit into contact with the rear-side contact portion and then perform the operation of bringing the drive transmission unit into contact with the front-side contact portion, and notifies of an error in a case where an amount of movement from the rear-side contact portion to the front-side contact portion is less than a predetermined amount.

11. The printing apparatus according to claim 1, wherein the tray is movable to a take-out position being a position closer in the second direction to a take-out side where print media are taken out than any of the positions at which the tray receives the print media discharged from the discharging unit.

12. The printing apparatus according to claim 1, wherein the control unit obtains information on position of the tray in the second direction on a basis of a reference position determined by the contact portion and the amount of relative movement, and controls the drive unit according to the information.

13. The printing apparatus according to claim 1, further comprising a print head configured to print an image on a print media and the discharging unit discharges the print media printed by the print head.

14. A method of controlling a printing apparatus comprising a discharging unit configured to discharge print media, a tray configured to receive print media discharged in a first direction from the discharging unit, a drive unit configured to move the tray in a second direction crossing the first direction;

a drive transmission unit configured to be joined to the tray and to be used for transmitting drive of the drive unit to the tray;

a contact portion to which the drive transmission unit contacts as the drive transmission unit is moved in the second direction; and a detecting unit configured to detect an amount of relative movement of the tray, the method comprising:

in discharging print media by the discharging unit, moving the tray in the second direction to thereby receive the discharged print media at a plurality of different positions on the tray; and controlling the drive unit on a basis of a reference position determined by the contact portion and the amount of relative movement.

15. The method of controlling a printing apparatus according to claim 14, wherein the drive unit moves the tray to the take-out position after a sorting is finished.

16. The method of controlling a printing apparatus according to claim 14, wherein the printing apparatus further comprises a scanner unit above the tray in a vertical direction.

17. The method of controlling a printing apparatus according to claim 14, wherein the printing apparatus further comprises a sheet feeding unit provided below the tray in a vertical direction and configured to feed the print media, and the second direction is a same direction as a direction in which the sheet feeding unit is pulled out.

18. The method of controlling a printing apparatus according to claim 17, wherein the take-out side where print media are taken out is a side where a member for pulling out the sheet feeding unit is provided.

19. A printing apparatus comprising:

a discharging unit configured to discharge print media;

a tray configured to receive print media discharged in a first direction from the discharging unit;

a drive unit configured to move the tray in a second direction crossing the first direction;

a drive transmission unit configured to be joined to the tray and to be used for transmitting drive of the drive unit to the tray;

a contact portion to which the drive transmission unit contacts as the drive transmission unit is moved in the second direction;

a detecting unit configured to detect an amount of relative movement of the tray; and a control unit configured to control the drive unit, wherein in discharging print media by the discharging unit, the tray is moved in the second direction to thereby receive the discharged print media at a plurality of different positions on the tray, and the control unit obtains information on position of the tray in the second direction on a basis of a reference position determined by the contact portion and the amount of relative movement.

* * * * *